US006916092B2

(12) United States Patent
Koitabashi et al.

(10) Patent No.: US 6,916,092 B2
(45) Date of Patent: Jul. 12, 2005

(54) RECORDING METHOD

(75) Inventors: Noribumi Koitabashi, Yokohama (JP); Hitoshi Tsuboi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 82 days.

(21) Appl. No.: 09/131,744

(22) Filed: Aug. 10, 1998

(65) Prior Publication Data

US 2004/0201656 A1 Oct. 14, 2004

(30) Foreign Application Priority Data

Aug. 11, 1997 (JP) ..... 9-216373

(51) Int. Cl.[7] ..... B41J 2/01

(52) U.S. Cl. ..... 347/105; 106/31.43; 106/31.59; 106/31.57; 347/106; 428/32.1

(58) Field of Search ..... 347/105, 106; 106/31.43, 31.59, 31.57; 428/32.1

(56) References Cited

U.S. PATENT DOCUMENTS

| | | | | |
|---|---|---|---|---|
| 4,313,124 A | | 1/1982 | Hara | 346/140 |
| 4,345,262 A | | 8/1982 | Shirato et al. | 346/140 |
| 4,459,600 A | | 7/1984 | Sato et al. | 346/140 |
| 4,463,359 A | | 7/1984 | Ayata et al. | 346/1.1 |
| 4,558,333 A | | 12/1985 | Sugitani et al. | 346/140 |
| 4,608,577 A | | 8/1986 | Hori | 346/140 |
| 4,723,129 A | | 2/1988 | Endo et al. | 346/1.1 |
| 4,740,796 A | | 4/1988 | Endo et al. | 346/1.1 |
| 5,608,438 A | * | 3/1997 | Koike et al. | 347/100 |
| 5,614,931 A | * | 3/1997 | Koike et al. | 347/43 |
| 5,864,350 A | * | 1/1999 | Shioya et al. | 347/40 |
| 5,955,515 A | * | 9/1999 | Kimura et al. | 523/161 |
| 5,959,641 A | * | 9/1999 | Yokoi | 347/21 |
| 6,062,674 A | * | 5/2000 | Inui et al. | 347/43 |
| 6,612,691 B1 | * | 9/2003 | Koitabashi et al. | 347/105 |

FOREIGN PATENT DOCUMENTS

| | | | | |
|---|---|---|---|---|
| EP | 588241 | * | 3/1994 | C09D/11/00 |
| EP | 0 671 268 A1 | | 9/1995 | |
| EP | 0 726 148 A2 | | 8/1996 | |
| EP | 0 726 158 A1 | | 8/1996 | |
| JP | 54-56847 | | 5/1979 | |
| JP | 58-128862 | | 8/1983 | |
| JP | 59-123670 | | 7/1984 | |
| JP | 59-138461 | | 8/1984 | |
| JP | 60-71260 | | 4/1985 | |
| JP | 10-44394 | | 2/1998 | |

OTHER PUBLICATIONS

Patent Abstracts of Japan, vol. 018, No. 620 (M–1711), Nov. 25, 1994 (with respect to JP 6–239013 of Aug. 30, 1994).

Database WPI, Derwent Publications Ltd., AN 197937735b, XP002141148 (with respect to JP 54–43733 of Apr. 6, 1979).

* cited by examiner

*Primary Examiner*—Pamela R. Schwartz
(74) *Attorney, Agent, or Firm*—Fitzpatrick, Cella, Harper & Scinto

(57) ABSTRACT

A recording method includes a step of ejecting onto a recording material ink having a Ka value of not more than 3 ($ml.m^{-2}.msec^{-1/2}$), applying to the ink deposited on the recording material processing liquid having a Ka value of not less than 5 ($ml.m^{-2}.msec^{-1/2}$) to insolubilized a coloring material in the ink inside the recording material; wherein the processing liquid is applied to the ink after rapid swell start point to after penetration of the ink into the medium passes after the ink is deposited on the recording material.

13 Claims, 22 Drawing Sheets

RECORDING METHOD

FIELD OF THE INVENTION AND RELATED ART

The present invention relates to a recording method and a recording device, more particularly to a recording method and a recording device wherein recording is effected by ejecting ink for image recording and processing liquid.

In the ink jet recording field, it is generally preferable that ink is quickly fixed on a recording material. Here, this fixing is not the fixing by penetration of the liquid.

Japanese Laid-open Patent Application No. SHO-58-128862 discloses that oily processing liquid is applied to an image region formed by the dye ink before or after the ink application, by which the coloring material is fixed on the recording material to improve the water-resistance.

Japanese Patent Application No. HEI-8-204618 and Japanese Laid-open Patent Application No. HEI-10-44394 assigned to the assignee of this application disclose that cationic processing liquid is applied on a topping-type or non-penetrative type ink (the ink having less penetration property) deposited on the surface of the recording material to cause an instantaneous reaction to produce reaction products thereof on the surface of the ink.

When the ink is ejected following the processing liquid, the water-resistance and the bleeding prevention between different colors can be improved, but since the coloring material in the ink is insolubilized on the surface of the recording paper, a blocking layer is formed on the surface of the recording paper by the insolubilized coloring material and therefore, the penetration of the ink into the recording paper is suppressed.

As a result, the insolubilized coloring material tends to remain on the surface of the recording paper, and therefore, the wear resistance, and the resistance against the overwriting when a line marker or a writing device is used to write on the recorded image(overwriting resistance) are not good. In other words, when the recording paper having the recorded image is rubbed, the coloring material on the surface is removed resulting in the deterioration of the image quality, or spread occurs upon overwriting.

SUMMARY OF THE INVENTION

Accordingly, it is a principal object of the present invention to provide a recording method and apparatus wherein the water-resistance of Bk ink is improved, the spread between the Bk ink and the color ink is reduced, and the image quality of the Bk ink is improved; and in addition, the water-resistance, the wear resistance, and the overwriting resistance immediately after the printing, are improved.

In the present invention, a processing liquid capable of reacting with and fixing a coloring material of ink is supplied to the ink, which has penetrated the fibers of the recording material and which has started to swell ("swelled ink" which is the ink after the swell start time Ts has elapsed or the ink changed by a heater or the like). The property of the processing liquid or the heating after the processing liquid application or the like, is usable.

As the first step:

(1) it is preferable to apply an ultra-penetrative($Ka \geqq 5$) processing liquid to an ink having $Ka \leqq 3$ m $m^{-2}.msec^{-1/2}$;

(2) it is preferable that when ink has $Ka \leqq 1$ and has a penetration property that exhibits temperature dependence, heat is applied by a heater after ink application to the recording material, and then a penetrative processing liquid, which is semi-penetrative or more penetrative, is applied; and (3) it is preferable that when the ink is semi-penetrative or more penetrative ($Ka>1$), heat is applied by a heater after ink application to the recording material, and thereafter, semi-penetrative or more penetrative processing liquid is applied. Further preferably, as a second step, heat is applied by a heater after the first step. The processing liquid in this case may by a semi-penetration property.

This is effective to promote the penetration of the processing liquid by the heater and to improve the fixing property by evaporation promotion.

An ultra-penetrative processing liquid may be used, and in such a case, the fixing property is further improved by evaporation promotion, and coating reinforcement is accomplished. By the second step, further advantages are provided.

According to an aspect of the present invention, there is provided a recording method comprising:

a step of ejecting onto a recording material ink having a Ka value of not more than 3 ($ml.m^{-2}.msec^{-1/2}$); and a step of applying to the ink deposited on the recording material, a processing liquid having a Ka value of not less than 5 ($ml.m^{-2}.msec^{-1/2}$) to insolubilize a coloring material in the ink inside the recording material;

wherein the processing liquid is applied to the ink after the rapid swell start point ts after penetration of the ink into the medium passes after the ink is deposited on the recording material.

According to another aspect of the present invention, there is provided a recording method comprising the steps of:

applying heat to the ink; and applying to the ink, a processing liquid having a Ka value not less than 1 ($ml.m^{-2}.msec^{-1/2}$).

According to a further aspect of the present invention, there is provided a recording method comprising the steps of:

ejecting to a recording material, ink having a Ka value not more than 1 ($ml.m^{-2}.msec^{-1/2}$) and having a penetration property which increases with heat; then applying heat to the ink; and applying to the ink, a processing liquid having a Ka value not less than 1 ($ml.m^{-2}.msec^{-1/2}$).

According to a further aspect of the present invention, there is provided a recording method comprising the steps of:

depositing ink containing a coloring material having a polarity onto a recording material; and then applying to the ink, a processing liquid having a polarity opposite from that of the coloring material after the rapid swell start point ts after penetration of the ink into the recording material, so that the coloring material in the ink is insolubilized by the processing liquid at least inside the recording material.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

First, the present invention will be summarized.

In the present invention, a processing liquid capable of reacting with and fixing a coloring material of ink is supplied to the ink that has penetrated the fibers of the recording material and that has started to swell ("swelled ink" which is the ink after the swell start time Ts has elapsed or the ink changed by a heater or the like). The property of the processing liquid or the heating after the processing liquid application or the like, is usable.

As the first step:

(1) it is preferable to apply an ultra-penetrative($Ka \geqq 5$) processing liquid to an ink having $Ka \leqq 3$ m $m^{-2}.msec^{-1/2}$;

(2) it is preferable that when ink has $Ka \leqq 1$ and has a penetration property that exhibits temperature dependence, heat is applied by a heater after ink application to the recording material, and then penetrative processing liquid, which is semi-penetrative or more penetrative, is applied; and (3) it is preferable that when the ink is semi-penetrative or more penetrative ($Ka>1$), heat is applied by a heater after ink application to the recording material, and thereafter, semi-penetrative or more penetrative processing liquid is applied. Further preferably, as a second step, heat is applied by a heater after the first step. The processing liquid in this case may by a semi-penetration property.

This is effective to promote the penetration of the processing liquid by the heater and to improve the fixing property by evaporation promotion.

It may be an ultra-penetrative processing liquid, and in such a case, the fixing property is further improved by evaporation promotion, and coating reinforcement is accomplished. By the second step, further advantages are provided.

The ink deposited on the recording material penetrates in the direction of the depth. When the penetration is within a predetermined range, the processing liquid is ejected to the ink to react with and insolubilize the ink, thus providing an image having a high wearing property and a high image quality. This will be described in conjunction with FIG. 20.

Figure 20:
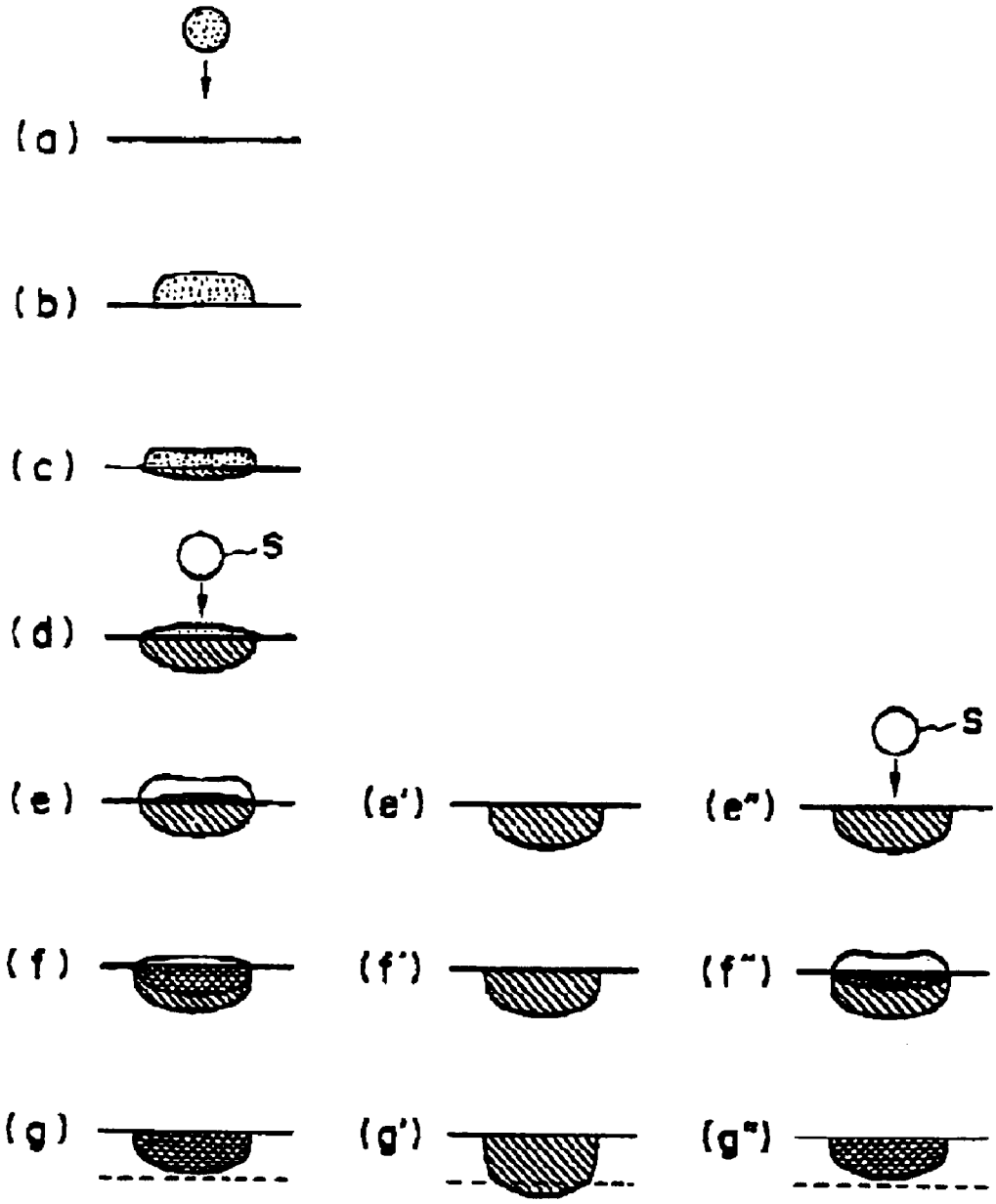
FIG. 20 illustrates a mechanism wherein processing liquid is ejected to a deposited ink with the state wherein the ink is penetrated in the direction of the depth (thickness) to within a predetermined range in the recording material, so that coloring material of the ink reacts in the paper to insolubilize the ink.

In FIG. 20, (a), the ink droplet is travailing toward the paper. In FIG. 20, (b), the ink droplet reaches the paper. At this time, the ink collapses into a column having a diameter which is approximately two times the ink droplet diameter. FIG. 20, (c) shows a state in which the ink is attracted in the fibers at the surface portion of the paper, and it swells. In FIG. 20, (d), the ink penetrates into the paper, and the processing liquid S is traveling toward the deposited ink. In FIG. 20, (e), the processing liquid is deposited on the ink and on the surface of the paper at the portion where the ink has been penetrated, and the processing liquid reacts with the ink. FIG. 20, (f) shows a state wherein the processing liquid catches up with the penetrated ink. As a result, the coloring material in the ink is insolubilized by the processing liquid inside the paper, so that ink now not easily penetrates in the direction of the depth of the paper. In FIG. 20, (g), the coloring material in the ink is insolubilized by the processing liquid, and the penetration stops. In this manner, not so much ink remains on the surface of the paper, but a large amount of the coloring material in the ink is insolubilized and trapped within 20 $\mu$m adjacent the surface of the paper.

On the other hand, when the processing liquid is not ejected, as shown in (e') (f') (g'), the coloring material is not trapped adjacent the surface of the paper, the OD value is not so high. On the other hand, if the processing liquid is ejected when the ink penetration is quite completed, the OD value is not so high as shown In (e'), (f'), (g'), since not so much coloring material remains on the surface.

The composition of the ink, the penetration property and the penetration speed will be described. The following is an example of the ink used in this embodiment:

(yellow (Y) ink)

C.I. Direct yellow 86=3 parts

Glyceline=5 parts

Diethylene glycol=5 parts

ACETYLENOL EH (ethyleneoxide-2, 4, 7, 9-tetramethyl-5-decyne-4,7-diol) (available from Kawaken Chemical Kabushiki Kaisha, Japan)=1 parts Water=rest (magenta (M) ink)

C.I. Acid red 289=3 parts

Glyceline=5 parts

Diethylene glycol=5 parts

ACETYLENOL EH (available from Kawaken Chemical Kabushiki Kaisha, Japan)=1 parts

Water=rest (cyan (C) ink)

C.I. Direct blue 199=3 parts

Glyceline=5 parts

Diethylene glycol=5 parts

ACETYLENOL EH (available from Kawaken Chemical Kabushiki Kaisha, Japan)=1 parts

Water=rest (black (Bk) ink)

C.I. Direct black=3 parts

Glyceline=5 parts

Diethylene glycol=5 parts

Urea=5 parts

ACETYLENOL EH (available from Kawaken Chemical Kabushiki Kaisha, Japan)=(will be explained hereinafter)

Water=rest

Therefore, each ink comprises dye or pigment, water, glyceline as a solvent, diethylene glycol, urea and ACETYLENOL EH which is a nonionic surfactant (which is a tradename of Kawaken Fine Chemical Kabushiki Kaisha, Japan), and is acetylene glycol added with ethyleneoxide, expressed by ethyleneoxide-2, 4, 7, 9- tetrainethyl-5-decyne-4, 7-diol. For the sake of simplicity, it is called acetylenol or ACETYLENOL EH. The ink used in this embodiment is a mixture of these materials. As regards the color ink(CMY), 1% of ACETYLENOL EH is added to improve the penetration property. As regards Bk ink the content of the ACETYLENOL EH is varied in the following experiments.

When the penetration property of the ink is expressed by ink amount V per $lm^2$, the ink penetration amount V ($ml/m^2=\mu m$) at the time t from the ejection of the ink droplet is expressed by a known Bristow equation, as follows:

$$V=Vr+Xa(t-tw)^{1/2}$$

where Lt>tw

Immediately after the ink droplet drops on the surface of the recording paper, most of the ink droplet is absorbed by the unsmooth portion (rough surface portion of the surface of the recording paper) of the surface, and hardly any ink penetrates to inside the recording paper. The time up to this point is tw (wet time), and the absorption amount into the unsmooth portion up to this point is Vr. When the elapsed time from the deposition of the ink droplet exceeds tw, the penetration amount V increases by the amount proportional to $(t-tw)^{1/2}$. Fundamentally, Ka is a proportional coefficient for the increased amount, and corresponds to the penetration speed.

Figure 17:
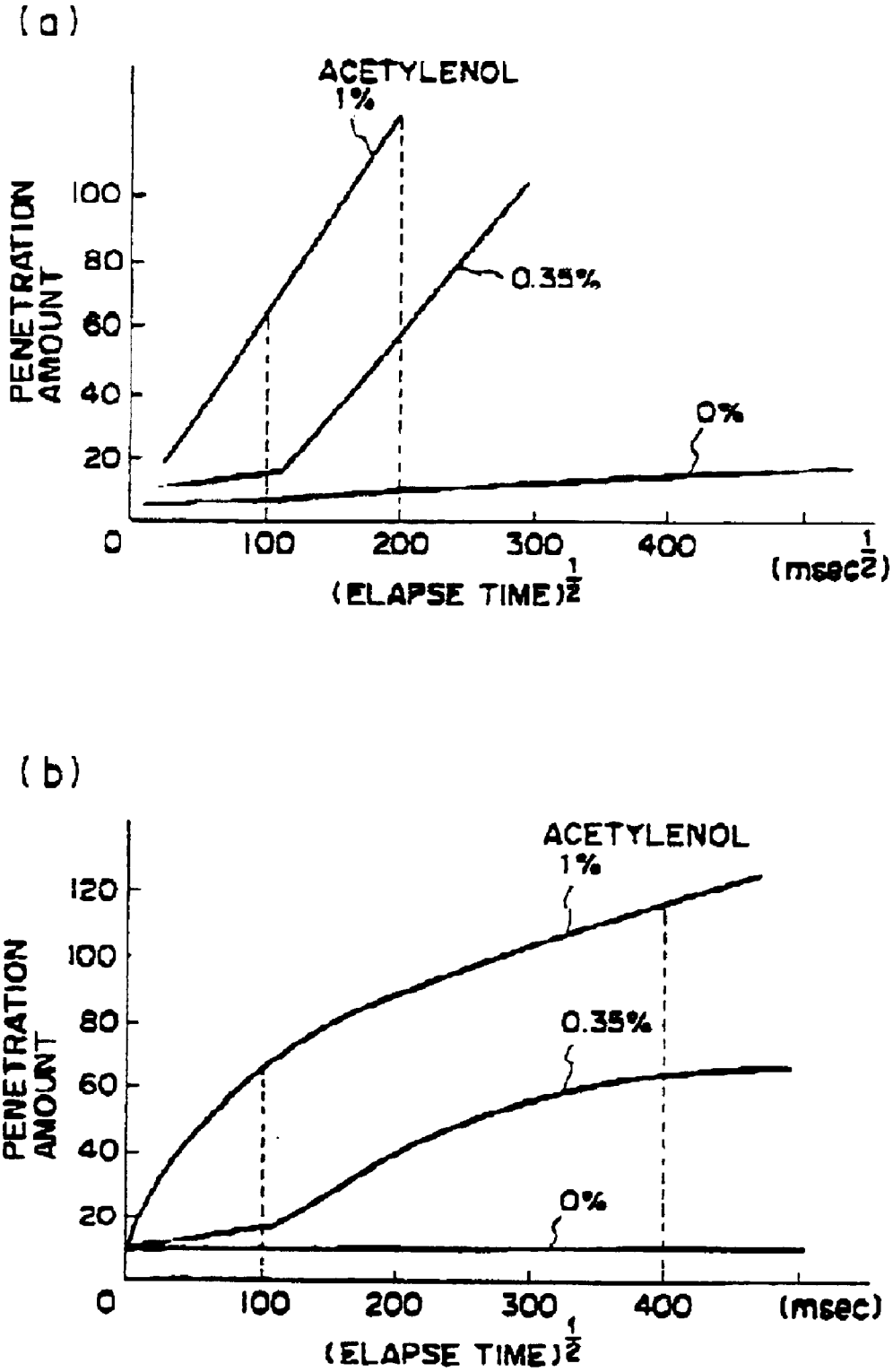
FIG. 17 is a characteristic graph showing the relation between the elapsed time and the penetration amount of the ink.
Figure 18:
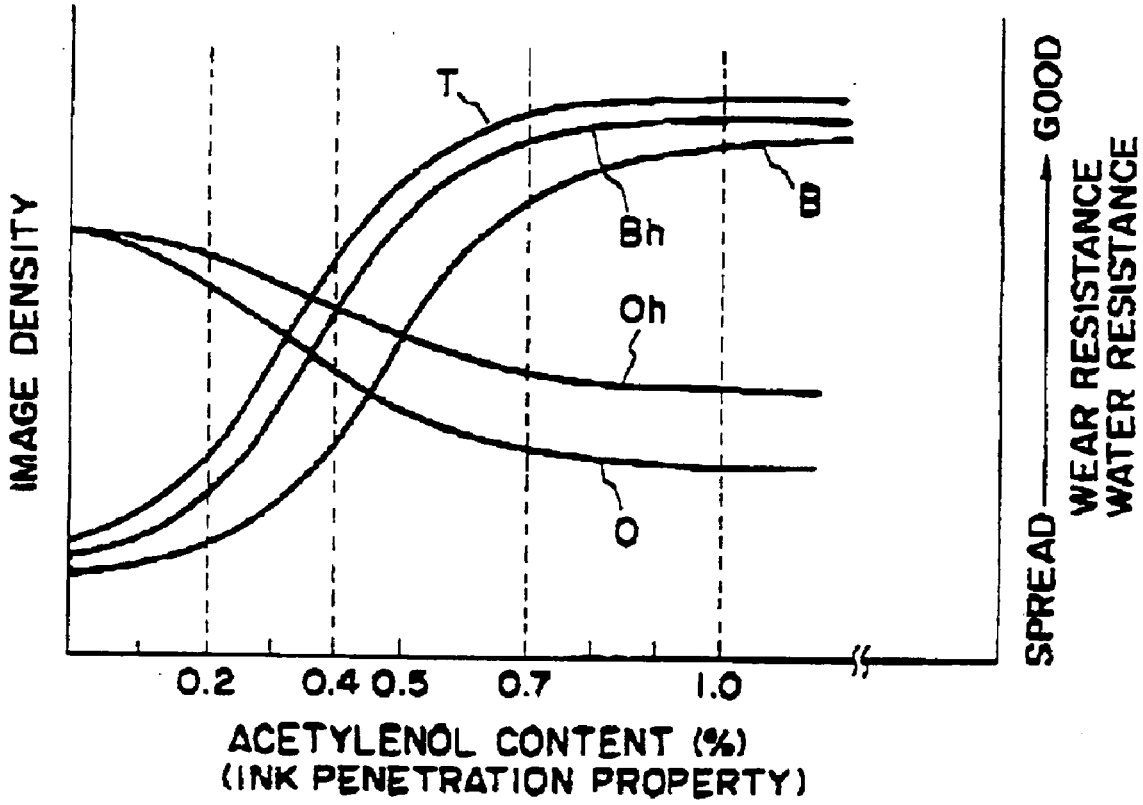
FIG. 18 shows image states of prints illustrating the difference depending on the difference in the acetylenol content when pigment ink is used.

FIG. 17 is a characteristic graph of the penetration amount of the ink vs. elapsed time, and plots experimental results when the recording paper has a weight of 64 $g/m^2$, a thickness of approximately 80 $\mu m$ and a porosity approximately 50%.

In FIG. 17, (a), the abscissa represents elapsed time $t^{1/2}$ ($msec^{1/2}$), and in FIG. 17, (b), the abscissa is the elapsed time t(msec). In both of the figures, the ordinate represents penetration amount V($\mu m$), and the plots when the acetylenol content is 0%, 0.35%, 1%, respectively are given.

As will be understood from these figures, the penetration amount of the ink relative to the elapsed time increases (penetration property is higher) with an increase of the content of the acetylenol. From FIG. 17, it is understood that wet time tw decreases with an increase of the content of the acetylenol, and in the time period not reaching tw, the penetration property is higher if the content is larger.

In the case of the ink not containing acetylenol(0% of the content), the penetration property is low, and is a topping-type ink which will be described hereinafter. When the content of the acetylenol is 1%, the ink penetrates the recording paper 103 quickly, and the ink is a high-penetration ink which will be described hereinafter. When the content of the acetylenol is 0.35%, the ink is a semi-penetrative ink.

Figure 21:
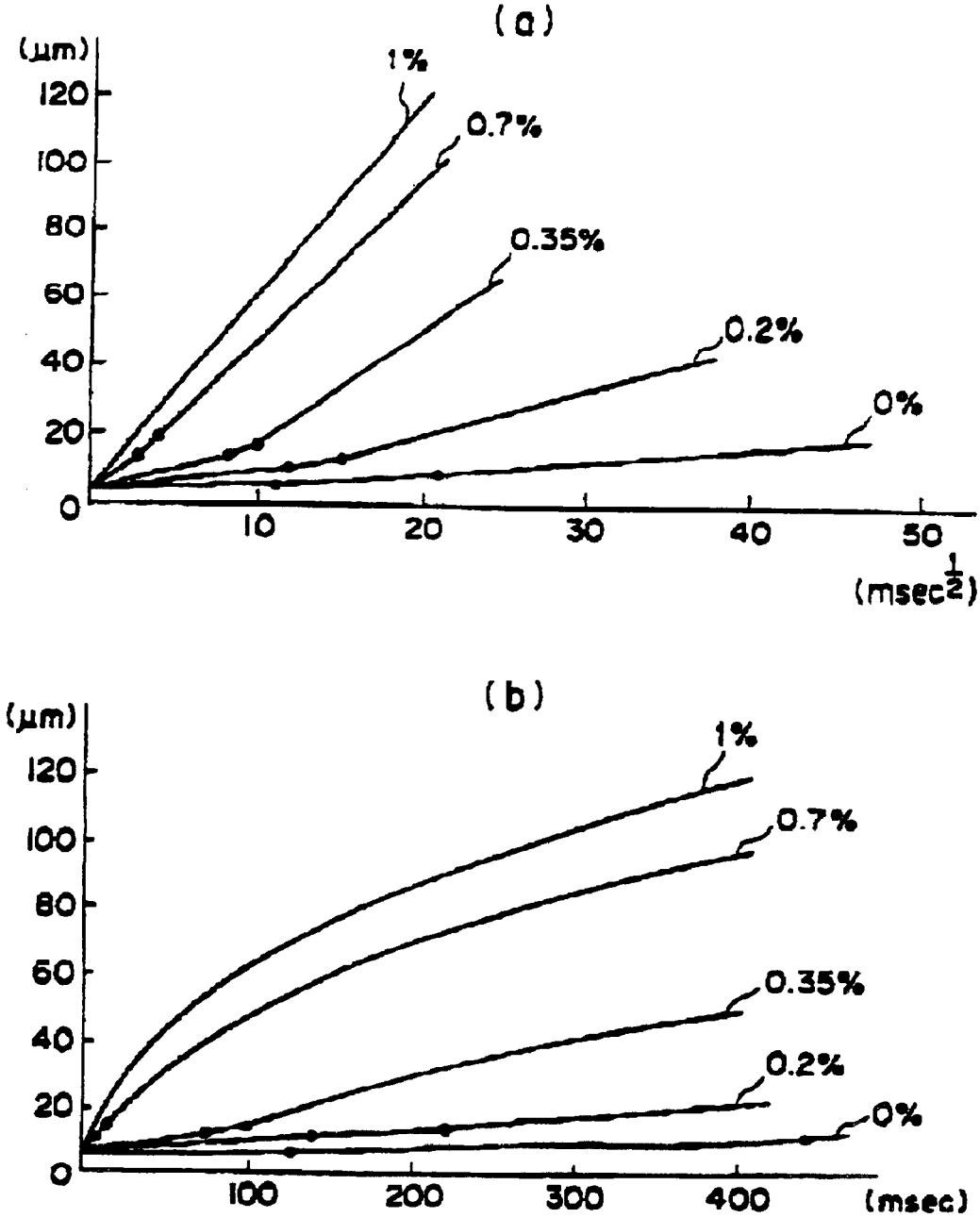
FIG. 21 illustrates the penetration speed of ink.
Figure 22:
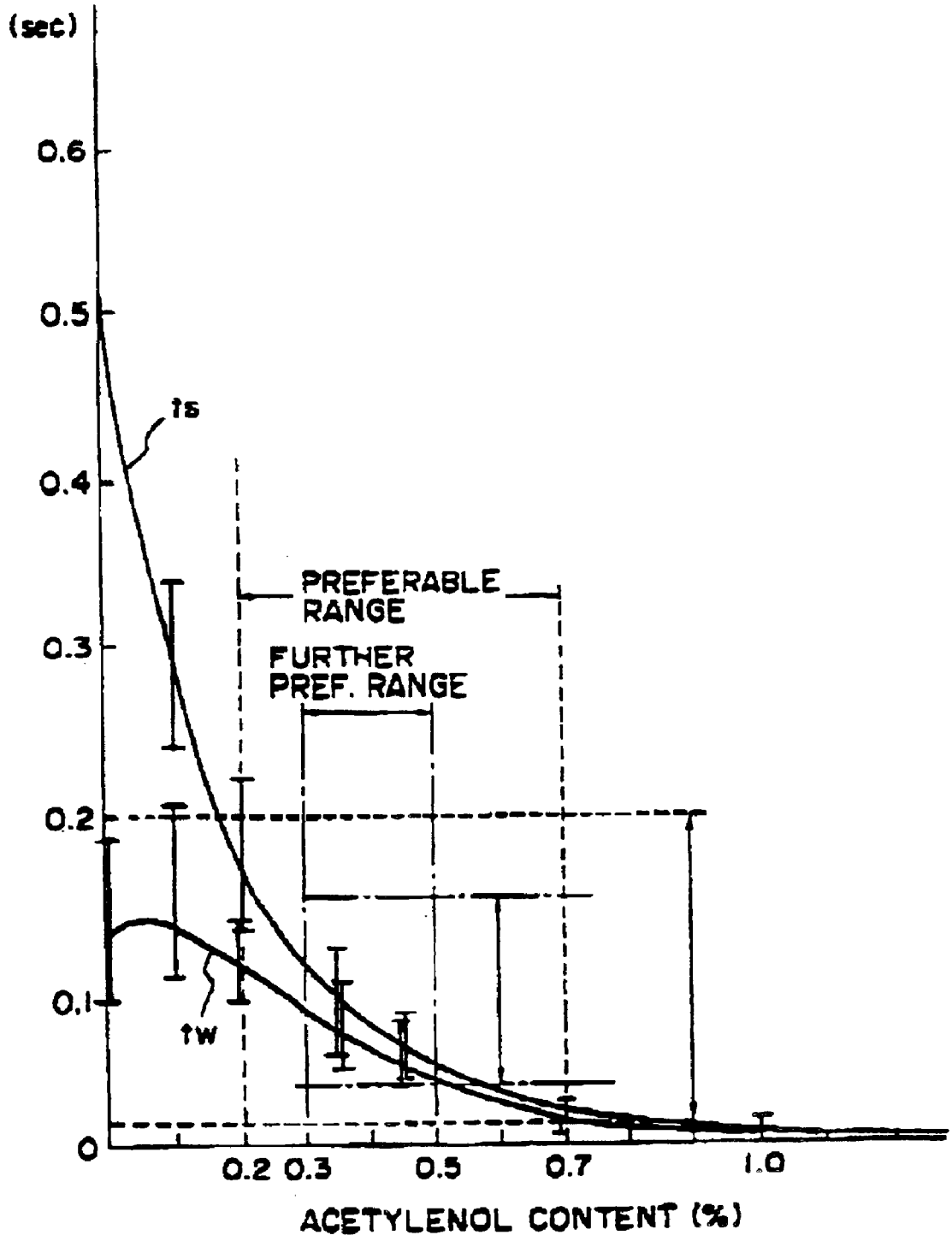
FIG. 22 shows the relation between acetylenol content in ink and tw, ts.

Referring to FIGS. 21 and 22, this will be described.

When a relatively low penetration property ink is used, during the time until tw at which the wettability of the surface of the sized paper is raised, the ink is attracted by the inks of the paper, and swelling occurs, and then the penetration starts due to the capillary action between the fibers.

In the case of so-called plain paper used with office equipment such as in a copying machine, the paper contains sizing material to prevent spread, and therefore, the penetration does not start quickly, which means there is a so-called wet time tw.

Even after the start of the penetration, the wettability of the ink relative to the paper does not rise due to the sizing material, and when the used ink is a so-called topping-type ink, it relatively slowly penetrates, and then the ink swells into the fibers per se from a certain point of time. The time is approximately 400–500 msec in the case of topping-type ink. The point of time is ts.

When a surfactant, such as acetylenol, is contained in the ink, the wettability of the ink relative to the paper is increased, the time becomes shorter, and the swell(into the attraction of the ink to the fibers) speed is increased. Then, the penetration speed is also high, and the ink quickly swells into the fibers of the paper. With the increase of the amount of the acetylenol, tw and ts become shorter, and it is substantially 0 when the content is 1%. Here, tw and ts becomes closer with an increase in the amount of the acetylenol, in the range of the 0.2–0.3% or higher content of the acetylenol. FIG. 22 shows such a relation as the amount of the acetylenol vs. tw and ts.

The penetration speed Ra is an inclination of the liquid absorption after ts.

After the point of time ts, the abrupt swell starts, and therefore, the ink on the surface of the paper enters the inside of the paper rapidly, and therefore, the ink fixing progresses.

When the processing liquid is overlaid on the ink ts after the shot of the ink droplet on the paper, the reaction therebetween occurs at the position of contact, while quite a larger part of the ink including the edge portion penetrates inside the paper, but a part may remain on the surface; and the reaction advances gradually into the ink inside the paper.

When the content of the acetylenol in the processing liquid is about 1%, the penetration starts immediately after the deposition since then tw is substantially zero.

Since the penetration speed thereof is higher than that of the ink, and the processing liquid penetrates the ink with reaction therewith, so that the penetration of the ink is stopped at a position shallower adjacent the surface of the paper than when the processing liquid is not deposited.

By doing so, much of the coloring material can be retained at a part close the surface of the paper, and thus the density is high. Even if a part of the ink remains on the surface of the paper immediately before the processing liquid is deposited on the ink, the ink does not remain on the surface of the paper at the edge portion of the ink dot, and therefore, so-called feathering, which is a bleeding in the form of whiskers, does not occur.

Even if a part of the ink remains on the surface, most of such ink penetrates, since the penetration property of the processing liquid is high.

Therefore, the amount of the coloring material at the surface of the paper is very small, and the wearing property is good.

If the content of the acetylenol is increased to more than 0.3% to raise the penetration property of the ink, feathering occurs abruptly after ts, depending on the material of the weight, and therefore, the content (weight %) is preferably not more than 0.3%.

When it is more than 0.3%, the penetration speed is so high that coloring material is not easily retained adjacent the surface of the paper even if the penetration speed of the processing liquid is increased, and therefore, it is preferably not more than 0.3%.

Figure 16:
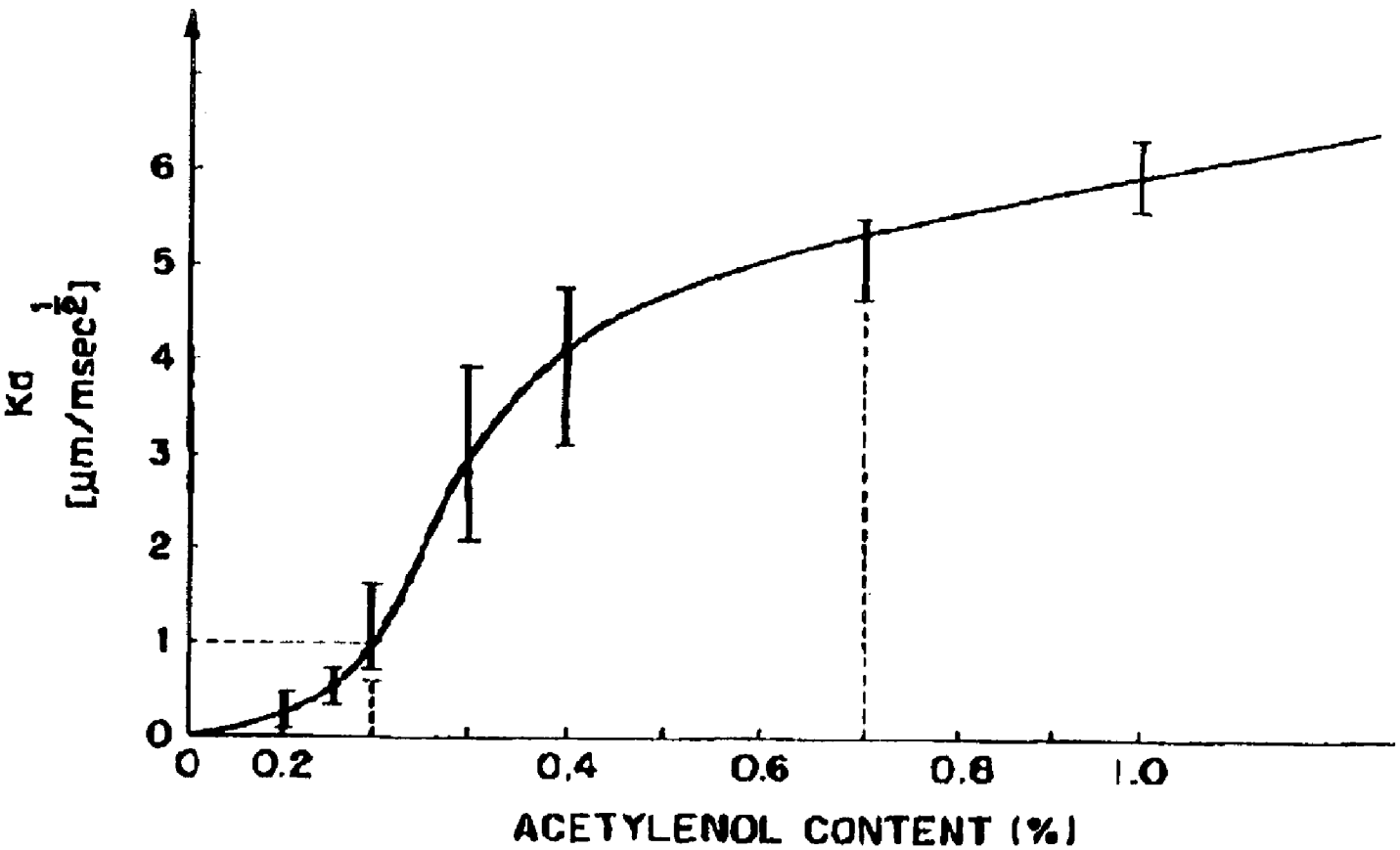
FIG. 16 shows a proportional coefficient Ka relative to the content of acetylenol in ink, empirically obtained.

FIG. 16 shows a proportional coefficient Ka relative to the content of acetylenol in ink, which is empirically obtained.

The value Ka is measured using a dynamic penetration property test apparatus S (available from Toyo Seiki Seisakusho, Japan) through the Bristow method. In the experiments, PB sheets available from Canon Kabushiki Kaisha, Japan were used as recording paper. The PB sheet is usable with a copying machine or LBP of electrophotographic type and also with a printer of ink-jet recording type.

The same results were obtained when PPC sheet which is an electrophotographic sheet available from Canon Kabushiki Kaisha, Japan.

From FIG. 16, it is understood that the Ka value(ordinate) increases with the increase of the acetylenol content (abscissa), and the proportional coefficient Ka is determined in terms of the content of the acetylenol. Therefore, the penetration speed of the ink is determined in effect by the content of the acetylenol. The lines parallel with the ordinate across the curves indicate the range of variation of the results of measurements.

Table 1 shows typical examples of the respective contents of the topping type ink, the semi-penetrative ink and high-penetrative ink in the description of the present invention.

TABLE 1

| | Ka value ($ml \cdot m^{-2} \cdot msec^{-1/2}$) | acetylenol content (%) | surface tension (dyne/cm) |
|---|---|---|---|
| topping type ink | –1.0 | 0.0–0.2 | 40– |
| semi-penetrative ink | 1.0–5.0 | 0.2–0.7 | 35–40 |
| high-penetrative ink | 5.0– | 0.7– | –35 |

In this table, the Ka value, the acetylenol content(%) and the surface tension(dyne/cm) are given for topping-type ink, semi-penetrative ink, and high-penetrative ink. The penetration property of each ink relative to the recording paper is higher if the Ka value is larger. In other words, it increases with a decrease in the surface tension.

The Ka values in Table 1 are determined by measurement using a dynamic-penetration-property test apparatus S, available from Toyo Seiki Seisakusho, Japan. In the measurements, the recording paper was the above-described PB sheet available from Canon Kabushiki Kaisha, Japan. Similar results were obtained for PPC sheet available from Canon Kabushiki Kaisha, Japan.

The semi-penetrative ink contains 0.2–0.7% of acetylenol.

As a condition when a surfactant is added to liquid, the critical micelle concentration (CMC) of a surfactant in the liquid is known. The critical micelle concentration is a concentration at which several tens of molecules rapidly form by association a micelle when the concentration of the surfactant in the liquid is increased. The acetylenol is one of surfactants, and therefore, it exhibits the critical micelle concentration for the respective liquids.

Figure 19:
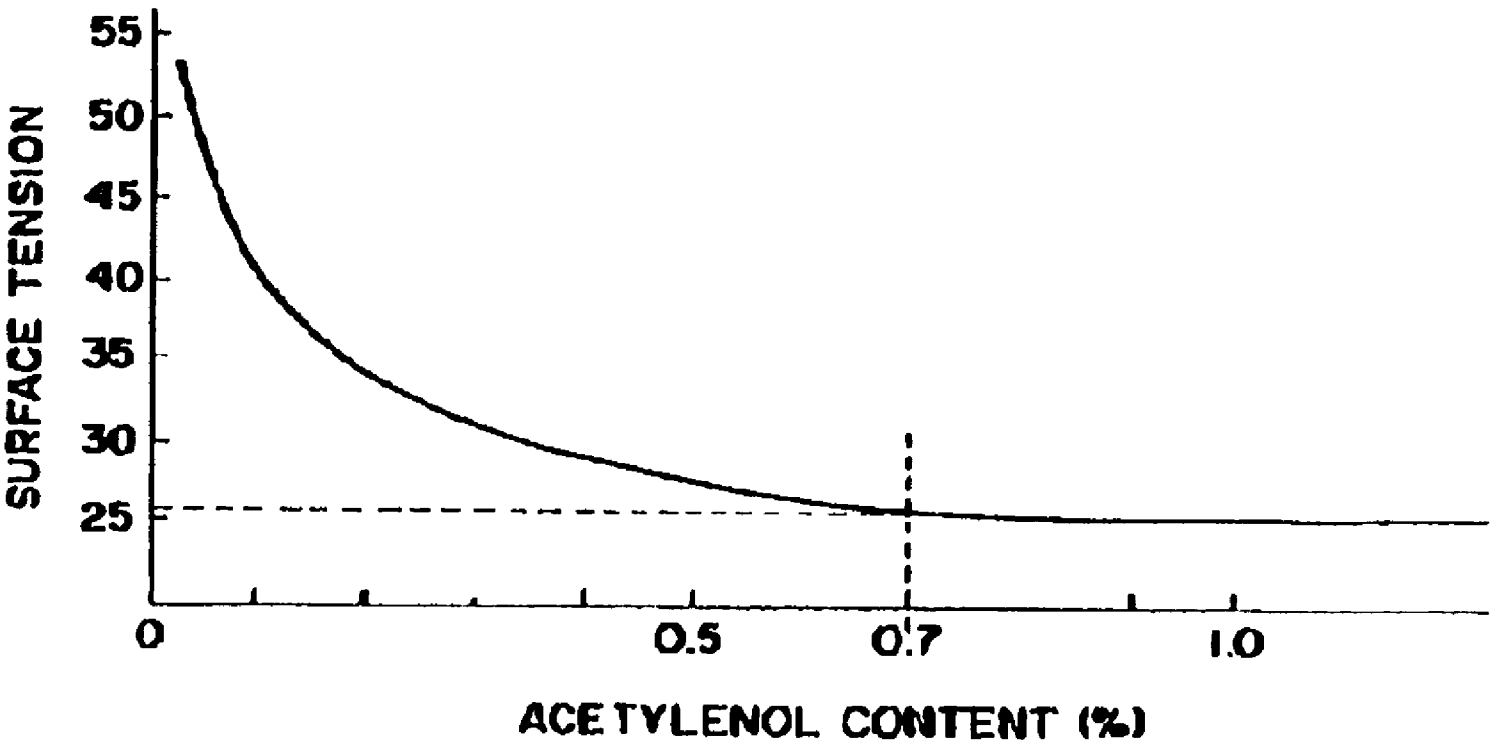
FIG. 19 is a characteristic graph showing a relation with the surface tension when content of the acetylenol in water is adjusted.

FIG. 19 is a characteristic graph showing a relation with the surface tension when content of the acetylenol in water is adjusted. When the cell is formed, the surface tension does not decrease, and therefore, it is understood from this figure that the critical micelle concentration (CMC) of the acetylenol relative to the water is approximately 0.7%.

When the critical micelle concentration and Table 1 are compared, it is understood that semi-penetrative ink, which is used in the embodiment of the present invention, which will be described hereinafter, and which is defined in Table 1, contains the acetylenol at a ratio which is smaller than the critical micelle concentration (CMC) of the acetylenol relative to the water.

A description will be provided as to the case of the processing liquid being ejected after the recording of the ink.

Particularly, the Bk ink is deposited, and then the processing liquid is printed, and thereafter, cyan (C), magenta (M) and yellow (Y) color inks are printed.

It is known that since the Bk ink is mainly used for characters and line images, and therefore, use of the ink having a low penetration property relative to the recording paper is effective as the Bk ink. Using this, the processing liquid was ejected after the recording was effected with the Bk ink. Then, the black coloring material was insolubilized on the surface of the recording paper, and the insolubilized coloring material remained on the surface of the recording paper, with the result that wear resistance or the overwriting resistance were not good.

The relation between the ejection time difference and the wear resistance is such that wear resistance improves with an increase of the ejection time difference. Particularly, when the black ink is a topping or non-penetrative ink, and the processing liquid is penetrative ink, the production of the feathering is very small when the ejection time difference from the ejection of the Bk ink to the ejection of the processing liquid is not less than approximately 1 second.

When the penetrative processing liquid is ejected while the ejected topping-type Bk ink is not penetrated into the thickness of the recording paper, a reacted liquid is normally produced by the mixture of the ink and the processing liquid, and the penetration property of the reaction liquid is higher than the penetration property of the Bk ink, with the result of a higher probability of feathering. However, by making the ejection time difference long (such as approximately 1 second or longer) between the ejection of the Bk ink and the ejection of the processing liquid, the processing liquid is ejected when the penetration of the Bk ink into the recording paper is substantially completed, and therefore, much less reacted liquid is produced. Thus, the coloring material is insolubilized by the processing liquid without feathering of the topping-type Bk ink.

By using a heater to heat the ejected Bk ink, the time required for the completion of the penetration of the Bk ink into the recording paper can be reduced by the temperature rise. By doing so, the ejection time difference between the ejection of the Bk ink to the ejection of the processing liquid can be shortened.

The composition of the Bk ink is preferably such that approximately 5% to 20% of the diethylene glycol (DEG), for example, is contained to the increase the penetration property by the rise of the temperature by the heater.

When the use is made with the Bk ink having a high penetration property, the image quality can be improved by shortening the ejection time difference between the ejection of the ink and the ejection of the processing liquid. The reason is that production of the feathering can be suppressed by the ejection of the processing liquid before the occurrence of the feathering of the Bk ink penetrating into the recording paper, and before the Bk ink reaches deep into the recording paper, the processing liquid reacts with the ink, by which the Bk ink is insolubilized in a range close to the surface of the recording paper, and the OD value is high.

However, the advantage in the image quality relating to the feathering and the OD value is provided at the cost of the wear resistance.

Therefore, there is a range where both of the image quality and the wear resistance are satisfactory.

By applying heat by a heater to the ejected Bk ink, the penetration of the Bk ink can be kept from reaching the deep position, and feathering can be suppressed, and therefore, the time range can be expanded, and satisfactory results can be obtained.

(Embodiments)

First Embodiment

Figure 1:
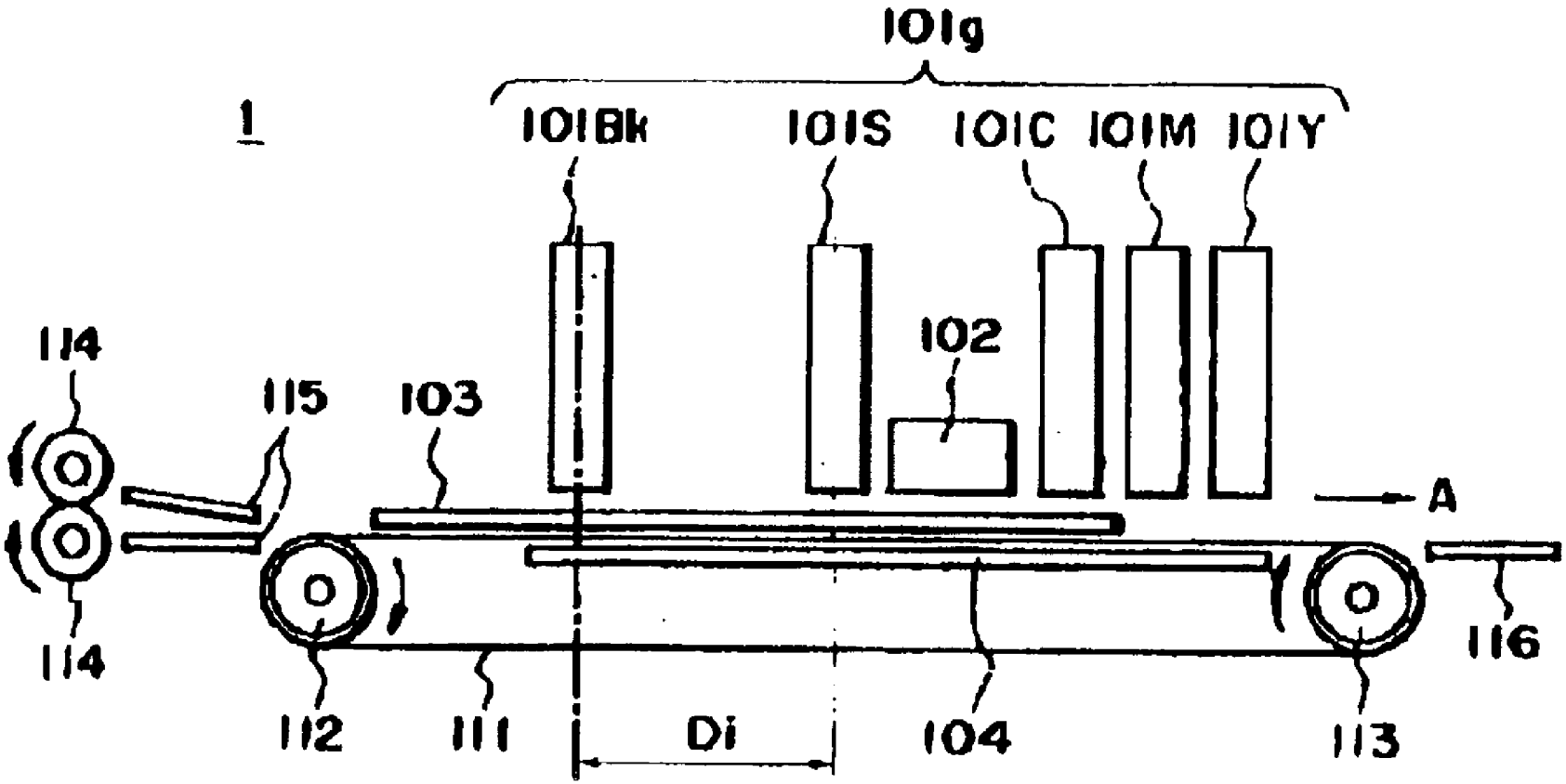
FIG. 1 is a side view of a full-line type recording device according to a first embodiment of the present invention.

FIG. 1 is a side view of a full-line type recording device according to a first embodiment of the present invention. The recording device 1 is of an ink-jet recording type wherein the ink is ejected from a plurality of ink jet recording heads of a full-line type arranged along a feeding direction of the recording paper(arrow A), and is controlled by a control circuit shown in FIG. 2, which will be described hereinafter.

Each of the recording heads 101Bk, 101S, 101C, 101M, 101Y in the recording head group 101*g* is capable of effecting recording over a predetermined region in the width direction of the recording paper, which is perpendicular to the vertical direction of the figure and the A direction, preferably over the entire width of the recording paper. Each recording head is provided with nozzles arranged substantially in the same direction as the width direction.

The recording paper 103 is fed in the direction A by the rotation of a pair of registration rollers 114 driven by a feeding motor, and is fed by a pair of guiding plates 115 so that it is fed to conveyer belt 111 with the leading edge thereof aligned with the ink ejection. The conveyer belt 111 is in the form of an endless belt, and is supported by two rollers 112, 113, and the vertical position thereof is limited by the platen 104 at the upper side. The recording paper 103 is fed by rotation of at least one of the rollers 112, 113. The roller is rotated by a driving source such as an unshown motor, in the direction for feeding the recording paper 103 in the direction indicated by the arrow A. The recording paper 103 is carried on the conveyer belt 111 and is subjected to a recording operation by the group of the recording paper heads 101*g* and is then discharged onto the stacker 116.

In the recording head group 101*g*, the recording head 101Bk for the black ink, the processing liquid head 101S for ejecting the processing liquid, and the color ink recording head(cyan head 101C, magenta head 101M, yellow head 101Y), are arranged as shown in the figure along the feeding direction A of the recording paper 103. By ejecting the inks and the processing liquid by the recording heads, multi-color recording is effected.

The composition of the processing liquid is as follows:

(processing liquid)

Glyceline=7 parts

Diethylene glycol=5parts

ACETYLENOL EH=(will be described) (available from Kawaken Chemical Kabushiki Kaisha, Japan)

Polyallylamine=4parts

Benzalkonium chloride=0.5parts

Triethylene glycol monobutylether-3parts

Water=rest

The content of the acetylenol was adjusted for each of the examples.

In this embodiment, a heater 102 is provided between the head 101S for the processing liquid and the head for the color ink, and the electric power supply control is effected such that heater 102 normally generates heat during the recording operation. In this embodiment, the heater 102 is a halogen lamp heater, and the black ink ejected on the recording paper 103 is heated at the recorded surface side. In this embodiment, the number of the heater is one, but a plurality of heaters may be used in consideration of the heating value per one heater and the desired heating value. The heater is used to improve the fixing property.

The black ink head 101Bk and the processing liquid head 101S are disposed with a predetermined clearance Di therebetween, and the ejection time difference between the ejection of the black ink and the ejection of the processing liquid is determined in accordance with the predetermined interval and the feeding speed of the recording paper 103. When the clearance Di between the black ink head 101Bk and the processing liquid head 101S is determined in the apparatus design, the feeding speed of the recording paper 103 is controlled to provide an ejection time difference of approximately 1 second so as to provide dot processing liquids. When the feeding speed is determined, the clearance between the black ink head 101Bk and the processing liquid head 101S is determined in compliance with the feeding speed.

Figure 2:
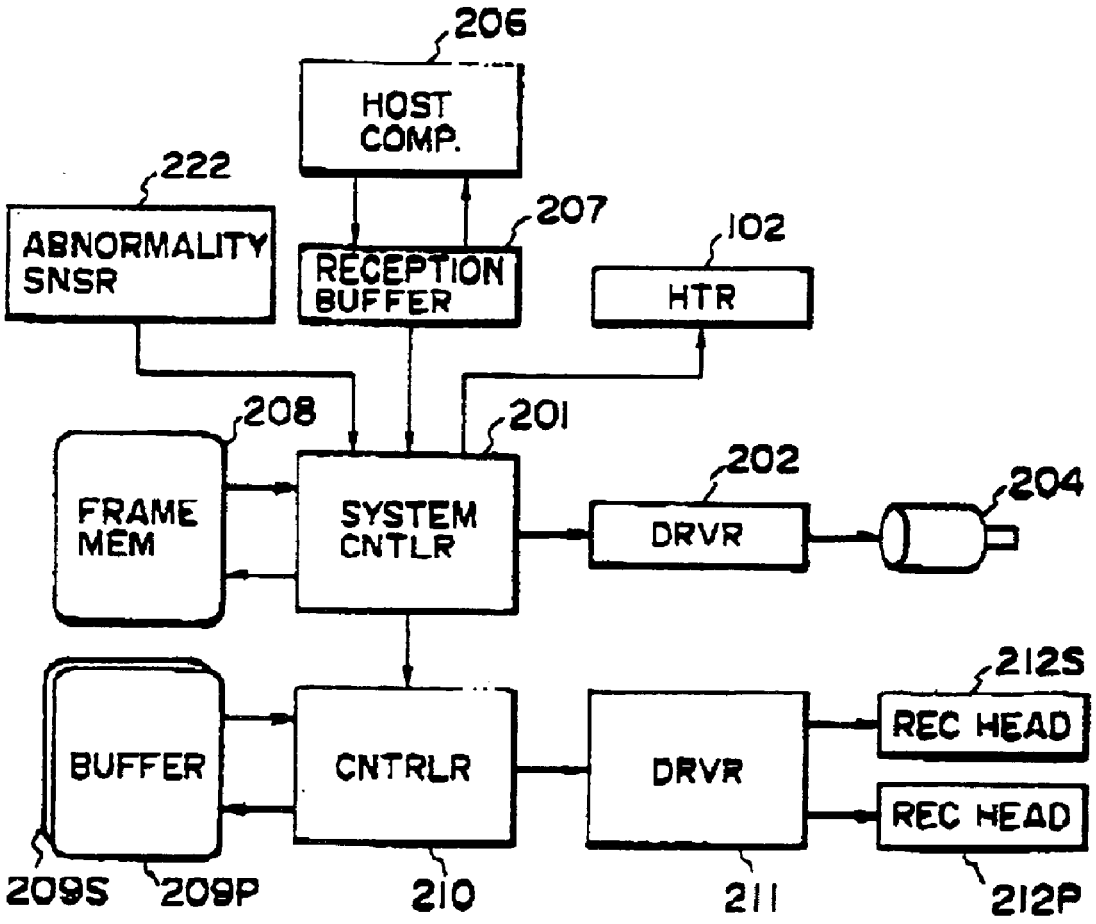
FIG. 2 is a block diagram of a control circuit for the full-line type recording device of the first embodiment.

FIG. 2 is a block diagram of the control circuit in the recording device 1 of the full-line type.

In the system controller 201, there are provided a micro-processor, a storing medium (ROM) storing the program for controlling device and processes, and storing material (RAM) for the operation of the micro-processor. The system controller 201 controls the entirety of the apparatus. The motor 204 operates in accordance with received information, such as the speed or movement distance from the driver 202, and feeds the sheet-like recording material, such as a recording paper, in the direction of arrow A in FIG. 1.

A host computer 206 functions to transfer the information to be recorded into the recording device 1 of this embodiment. A reception buffer 207 temporarily stores the data from the host computer 206, and accumulates them until the data from the system controller 201 is received. A frame memory 208 is a memory for converting the data to be printed to the image data, and has a memory size necessary for the printing. In this embodiment, the frame memory 208 is capable of storing data for one page of the recording paper, but the present invention is not limited to this.

Buffers 209S, 209P temporarily store the data to be printed, and the storing capacity is different if the nozzle number of the recording head is different. A print controller 210 functions to control the recording head in accordance with the instructions from the system controller 201, and controls the printing speed, the print data number or the like, and further it generates the data for ejecting the processing liquid. A driver 211 drives the recording head 212S for ejecting the processing liquid and the recording head 212P for ejecting the ink for the image recording, and is controlled by the signal from the print controller 210.

First, the image data is supplied from the host computer 206 to the reception buffer 207, and is temporarily stored there. Then, the image data stored are read by the system controller 201 and are converted into the buffers 209S, 209P. The system controller 201 controls the electric energization to the heater 102. A malfunction, such as a sheet jam, an ink shortage, a sheet shortage or the like, can be detected by detection signals from an abnormality sensor 222.

The print controller 210 generates the data for the processing liquid for ejecting the processing liquid on the basis of the image data in the buffer 209S, 209P. The ejecting operation of the recording heads are controlled on the basis of the data for the processing liquid and the image data in the buffers 209S, 209P.

Figure 3:
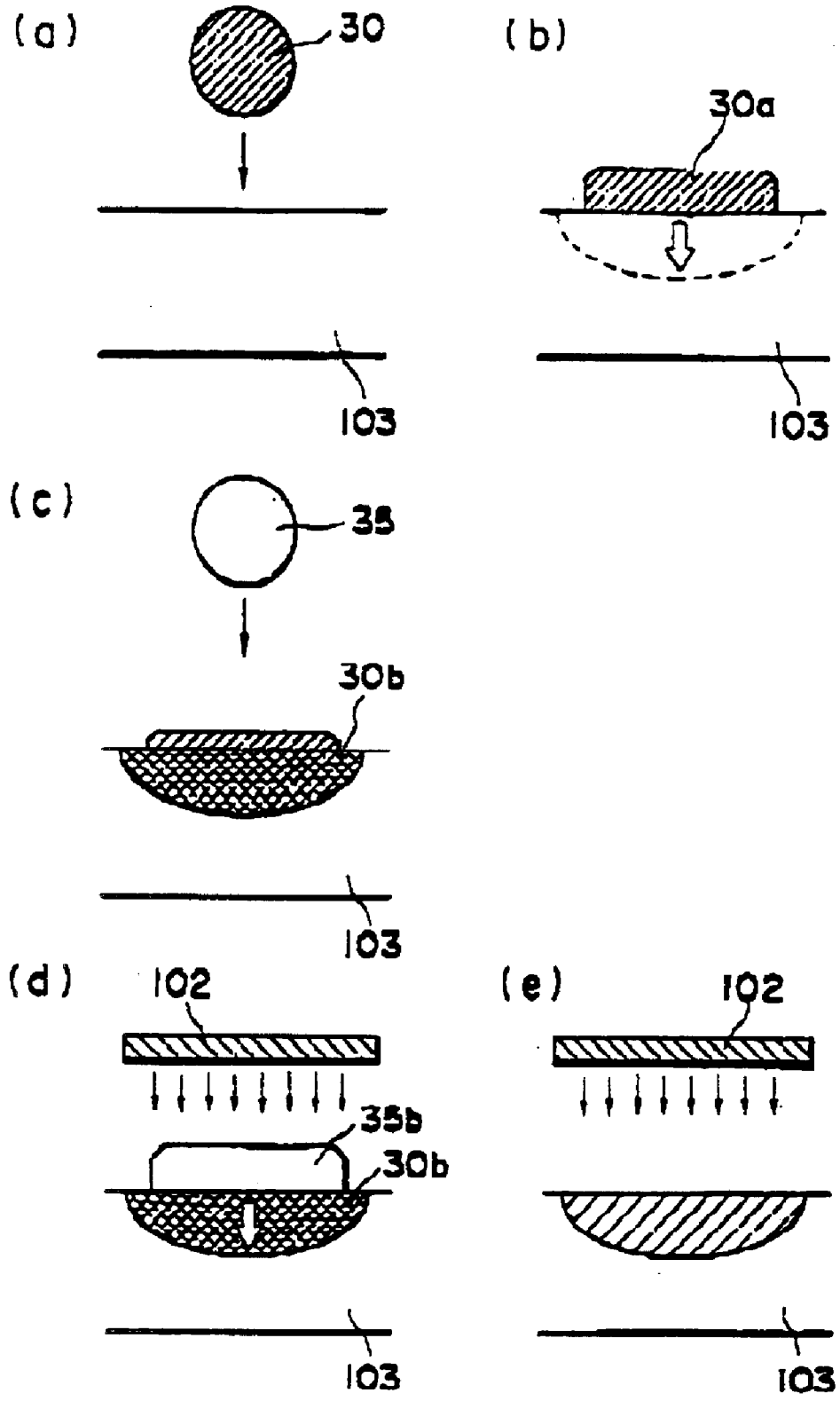
FIG. 3 is an illustration of a recording process, and an ink and dot on and in the recording sheet in the first embodiment.
Figure 4:
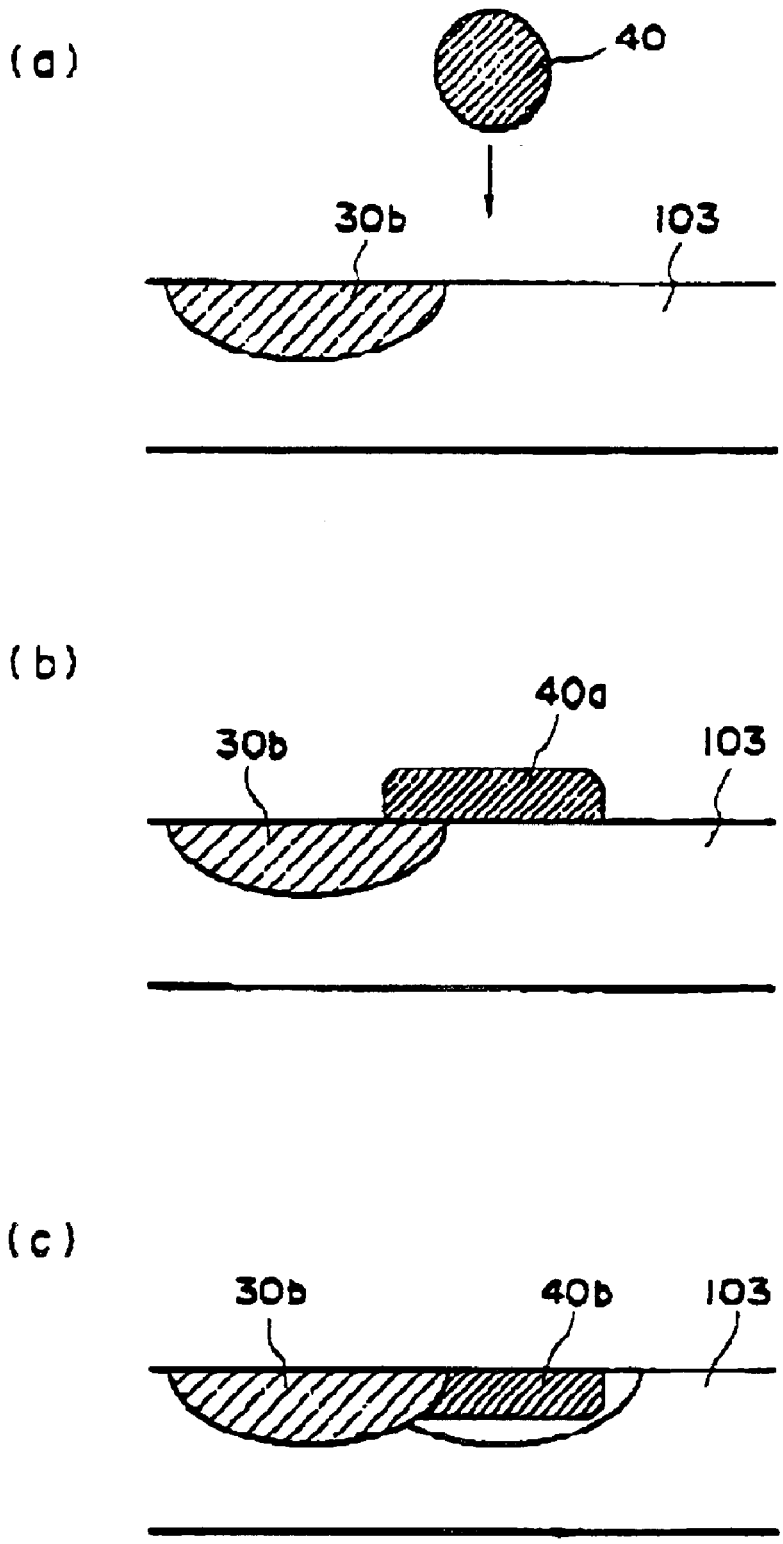
FIG. 4 is an illustration of a recording process, and an ink and dot on and in the recording sheet in the first embodiment.

Referring to FIGS. 3 and 4, a description will be provided as to the recording process in this embodiment and the state of the ink and the dot on and in the recording paper 103. In this embodiment, the black ink has a topping property in Table 1. The processing liquid has a certain degree of a penetration property, and the acetylenol content is approximately 0.4–1.0%.

The black ink droplet 30 is ejected by black ink head 101Bk (FIG. 3, (a)).

The black ink droplet 30*a* is deposited on the recording paper surface, and penetrates as indicated by a white arrow to the range indicated by the broken lines in the recording paper before the processing liquid droplet is ejected by the processing liquid head 101S (FIG. 3, (b)).

In this embodiment, the ejection time difference from the ejection of the black ink and the ejection of the processing liquid is approximately 1 second. During this, most of the black ink droplet 30*a* ejected from the head 101Bk for the black ink penetrates into the recording paper 103. When the approximately 1 second elapses from the black ink ejection while the recording paper 103 is being fed, a droplet 35 of the processing liquid(record improving liquid) having a certain degree of a penetration property is ejected onto the dot 30*b* provided by the ejection of the ink from the black ink head 101Bk (FIG. 3, (c)). At this time, the rapid swell start point ts has been exceeded. The processing liquid and the dye in the black ink react to insolubilize the dye in the recording paper 103.

The dot 30*b* provided by the black ink and the processing liquid droplet 35*a* ejected on the dot 30*b* are heated by the heater 102 (FIG. 3, (d)), by which evaporation of the water content in the black ink and in the solvent of the processing liquid is promoted, so that the reaction speed and the fixing property are enhanced (FIG. 3, (e)). Here, if the content of the acetylenol in the processing liquid is not less than 0.7%, the heating with the heater is not necessary, but the strength of the reaction liquid coating is improved by the heating.

Even when the content of the acetylenol is not more than 0.7%, the heat provides effects substantially similar to the ultra-penetrative.

As described in the foregoing, the black ink droplet 30 is ejected, and the processing liquid droplet 35 is ejected to be overlaid thereon with a delay of not less than ts to permit a certain degree of penetration of the black ink into the recording paper (approximately 1 second), so that ink can be insolubilized inside the recording paper.

In such an embodiment, the ink is insolubilized when it penetrates in the recording paper 103, so that wear resistance and the overwriting resistance as well as the recording paper 103 can be improved.

FIG. 4 shows the state of the ink and dot on and in the recording paper 103 when the color ink droplet 40 is ejected adjacent to the dot 30*b* provided by the black ink droplet 30 after the process shown in FIG. 3, (d).

In FIG. 4, (a), the color ink droplet 40 is ejected toward the neighborhood of the dot 30*b* provided by the black ink droplet 30 ejected onto the recording paper 103.

In FIG. 4, (b), the color ink droplet 40 is deposited on the surface of the recording paper 103, as a color ink droplet 40*a*.

In FIG. 4, (c), the color ink penetrates at a position adjacent to the dot 30*b* provided by the black ink droplet 30 to form the color dot 40*b*.

Here, the ink ejected by the color ink head (101C, 101M, 101Y) is a high-penetrative ink described above, and therefore, the penetration speed into the recording paper 103 is high, and the spread does not easily occur even if the other color ink is deposited to the neighborhood thereof. The black ink droplet 30 is a topping-type ink, which has a lower penetration property than the color ink. Therefore, when another color ink droplet is deposited to a position adjacent thereto, spreading easily occurs. However, since the processing liquid droplet 35*b* is overlaid on the dot 30*b* of black ink droplet 30, and the black ink is heated by the heater 102 if necessary, the ink is insolubilized in the recording paper 103.

Accordingly, as shown in FIG. 4, (b), even if the color ink droplet 40*a* is ejected to a position adjacent to the dot 30*b* provided by the black ink droplet 30, it does not produce a spread with the color ink. Even if the dot 30*b* of the black ink droplet 30 and the dot 40*b* of the color ink droplet 40*a* are adjacent to each other, there occurs no spread at the boundary between the dots 30*b* and 40*b*, and therefore, the image has a sharp boundary portion between different colors.

By the application of the processing liquid before the color ink, water-resistance can be provided for the color print.

(Modified Example of the First Embodiment)

A heater having a small heating value may be added between the head 101Bk for the black ink and the head 101S for the processing liquid (FIG. 1), by which the penetration of the black ink from the head 101Bk may be promoted into the recording paper 103.

The penetration of the black ink into the recording paper 103 may be promoted by using black ink containing 0.3% of the acetylenol so that its penetration property is slightly higher than the topping-type ink.

By using such a heating step or by using black ink having a relatively high penetration, the ts can be effectively shortened, and therefore, good images can be formed even with the ejection time difference reduced to less than 1 second, so that there is clearance between the black ink head 101Bk and the processing liquid head 101S to permit downsizing of the apparatus. When the clearance between the black ink head 101Bk and the processing liquid head 101S is determined in the design of the apparatus, the feeding speed of the recording paper 103 can be raised. The feeding speed is to be determined in consideration of the recording speed at which the recording head can properly eject the ink.

A processing liquid head 101 may be added downstream of the heads 101C, 101M, 101Y for the color inks with respect to the feeding direction A of the recording paper 103, so that processing liquid is ejected also to the dot provided by the color ink, by which the water-resistance of the color ink image can be improved.

Second Embodiment

Figure 5:
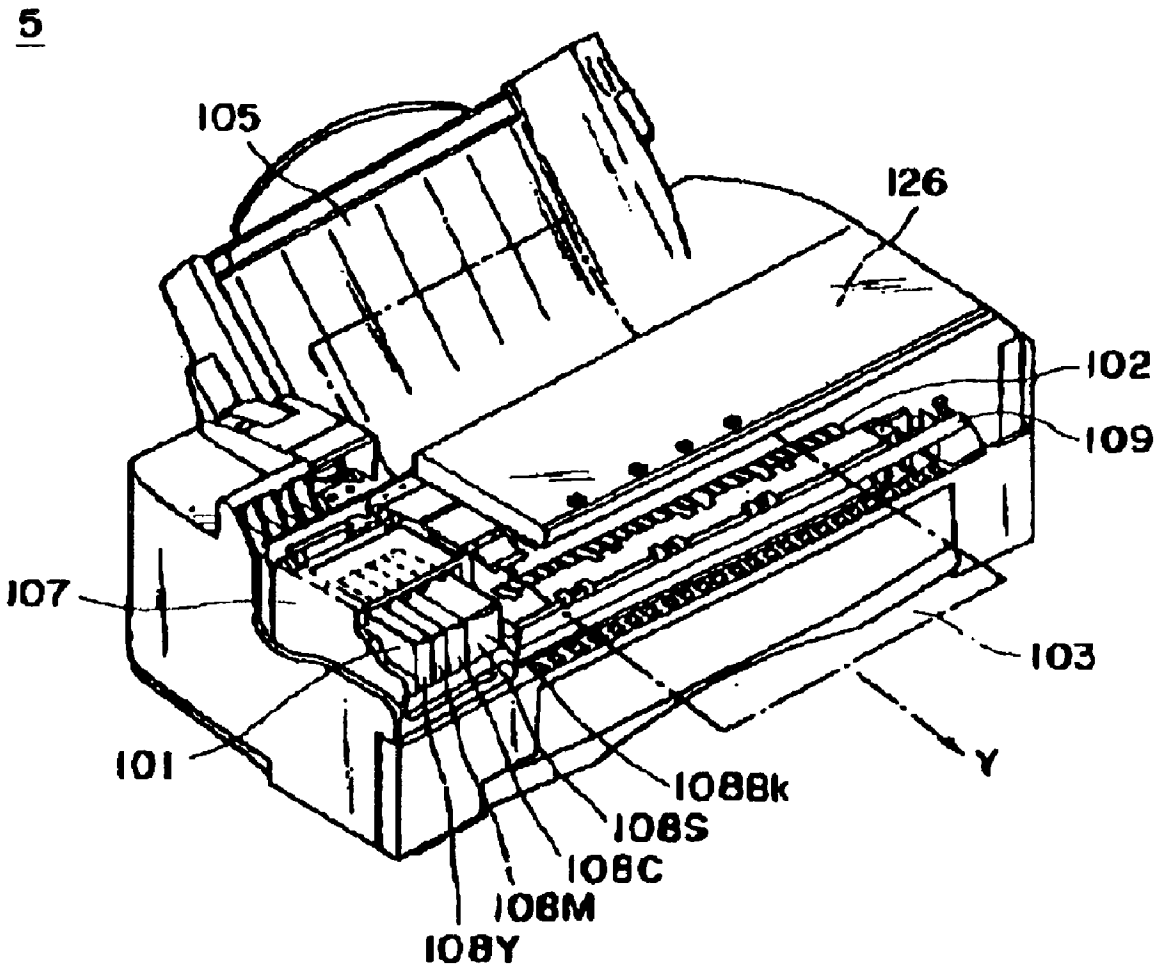
FIG. 5 is a schematic perspective view of a serial type recording device according to a second embodiment of the present invention.

FIG. 5 is a schematic perspective view of a structure of a recording device 5 of a serial type.

The recording paper 103 (recording material) is supplied from the sheet feeder 105 and is discharged through the printing portion 126. In this embodiment, the inexpensive plain paper is used as the recording paper 103. The printing portion 126 is provided with a recording head 101 carried on a carriage 107, and the recording head 101 is reciprocable along the guiding rail 109 by a motor 604 shown in FIG. 6. The recording head 101 has a black ejection portion 108Bk for ejecting black ink, a processing liquid ejecting portion 108S for ejecting processing liquid, and a cyan ejection portion 108C, a magenta ejection portion 108M and a yellow ejection portion 108Y for ejecting the respective color inks.

To each of the ejection portions, the ink is supplied from unshown ink container, and a driving signal is supplied to the electrothermal transducer (heater) for ejecting the liquid provided in each of the nozzles. By this, a bubble is generated in the ink by thermal energy applied to the ink, and the ink is ejected by the pressure resulting from the bubble generation. In other words, a so-called bubble-jet type is used for the ink ejection. Ejection outlets in the ejection portion are arranged in a perpendicular direction relative to the movement direction of the recording head 101, that is, in the same direction as the feeding direction X of the recording paper 103.

A heater 102 is provided so as to cover the entire area of the movement range of the carriage 107 at a position opposed to each of the ejection portions. In this embodiment, the heater 102 is in close contact to the recording paper 103 at the back side of the recording paper 103, and the heater 102 is a ceramic heater, which is suitable for the heating of the surface contacted thereto.

The recording head 101 effects the recording at the resolution of 360 dpi, and the driving frequency of the electrothermal transducer is 7.2 kHz. The carriage 107 completes one reciprocation in 1.5 seconds.

Figure 6:
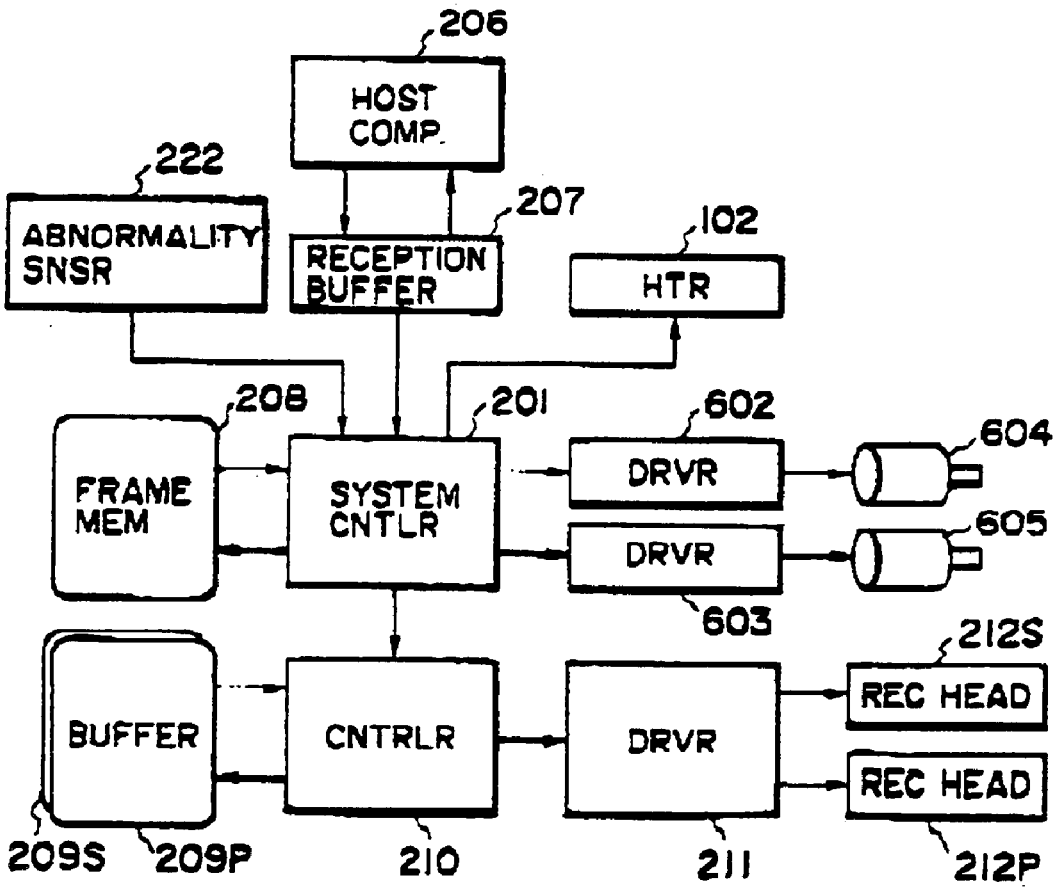
FIG. 6 is a block diagram of a control circuit of a serial-type recording device according to the second embodiment.

FIG. 6 is a block diagram of the control circuit for the recording device 5 of the serial type. The same reference numerals as in FIG. 2 are assigned to the elements having the corresponding functions, and detailed descriptions thereof are omitted for simplicity. The motor 604 of FIG. 6 receives information, such as a movement distance and speed, from the driver 602 and operates in accordance with the information to drive the recording head in the main-scanning direction (scanning direction). The motor 605 receives information, such as a movement distance and a speed, from the driver 602 and operates in accordance with the information to feed the sheet-like recording material, such as recording paper, in a sub-scan direction (feeding direction).

Figure 7:
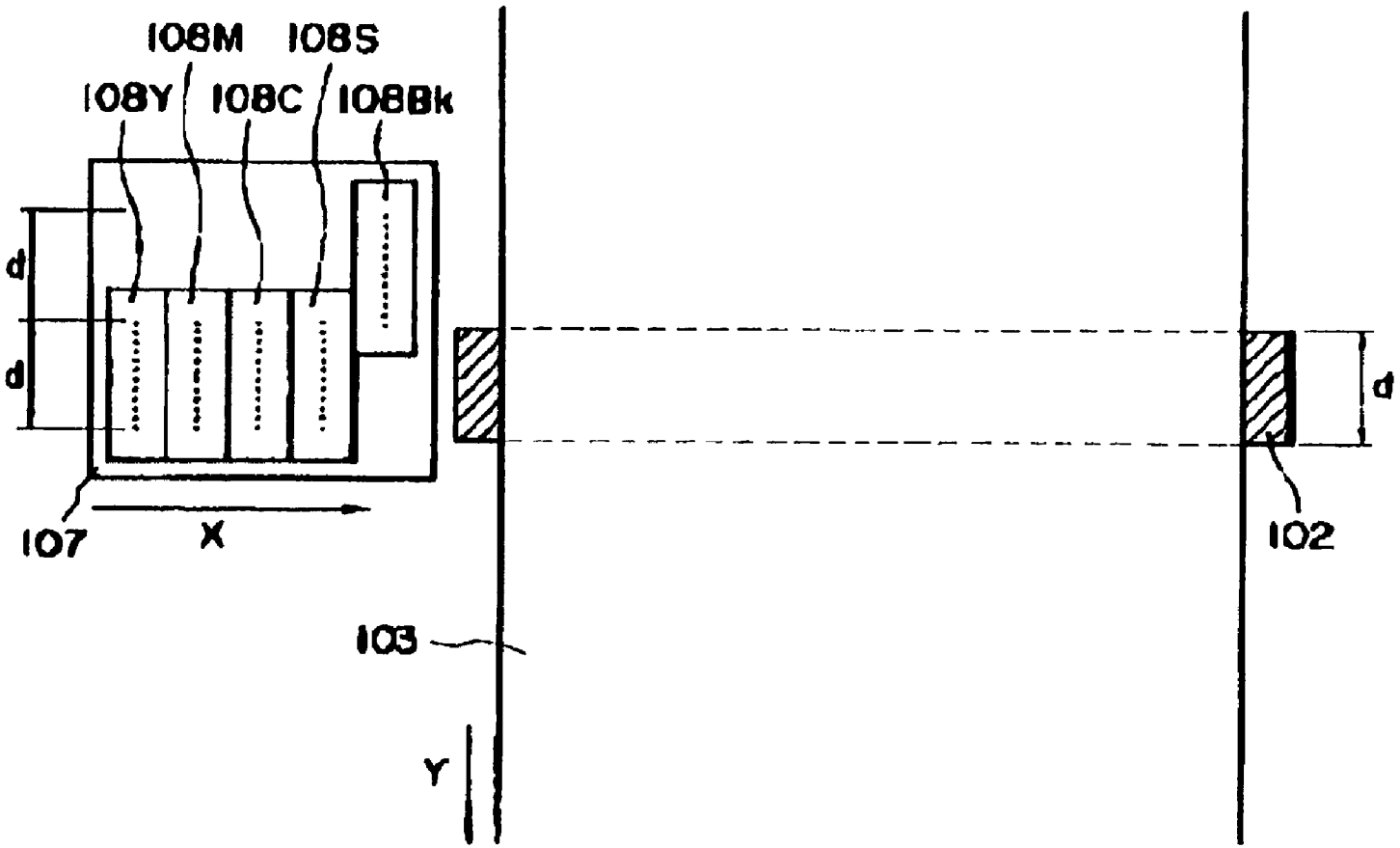
FIG. 7 is a schematic top plan view of a major part of an apparatus to illustrate a recording process in the recording device of a serial type according to second embodiment.

FIG. 7 illustrates a recording process of the recording device of the serial type shown in FIGS. 5 and 6, and is a plan view of the recording station 126.

In FIG. 7, the carriage 107 reciprocates in the X direction, which is substantially perpendicular to the feeding direction Y above the recording paper 103 fed in the Y direction in close contact with the heater 102. The ejection outlets (indicated by dots in the Figure) of the black ejection portion 108Bk, the processing liquid ejecting portion 108S, and the color ejecting portion (108C, 108M, 108Y) carried on the carriage 107, are opening in the direction of the ejection of the ink and the processing liquid against the recording paper 103. The heater 102 generates heat during the recording operation, and is provided at a position opposing to the region to which the liquid is ejected by the processing-liquid ejecting portion 108S and the color ejecting portions 108C, 108M, 108Y.

Each ejection portion has ejection outlets arranged to effect the recording in the width d along the feeding direction Y of the recording paper 103 by one scanning. In order to provide the time difference between the ejection of the ink by the black ejection portion 108Bk and the ejection of the processing liquid by the processing liquid ejecting portion 108S, the black ejection portion 108Bk and the processing liquid ejecting portion 108S are disposed with deviation by the recording width d in the feeding direction. The ejection time difference corresponds to the substantial completion of the penetration of the black ink to the predetermined range in the direction of the thickness of the recording paper. By such a constitution, the ejection of the ink by the black ejection portion 108Bk to the predetermined position of the recording paper 103 and the ejection of the processing liquid by the processing liquid ejecting portion 108S are effected with a deviation corresponding to one scan of the carriage 107 (scanning period is 1.5 seconds), thus providing the predetermined time difference. In this embodiment, therefore, the recording process that is substantially similar to the recording process of the recording device of the full-line type according to the first embodiment is accomplished in the recording device of a serial type.

In such a recording process, the black ink is ejected by the black ejection portion 108Bk in the first scanning. The region in which the black ink is ejected, is upstream of the position of the heater 102, and is not heated by the heater 102. Then, the sheet is fed by the recording width d with a time delay to permit the penetration of the black ink into the recording paper 103, and the next scanning is effected to the same region on the heater 102, so that a processing liquid droplet is ejected to be overlaid on the dot formed by the black ink, by the processing liquid ejecting portion 108S. The heat generation of the heater 102 is effective to promote the evaporation of the water content contained in the black ink and in the solvent of the processing liquid, so that the fixing property is improved, and the coloring material in the ink is insolubilized in the recording paper 103.

By doing so, the wear resistance and overwriting resistance, as well as the water-resistance, are improved.

Additionally, in this embodiment, the heater 102 is provided at the back side of the recording paper 103 in the region where the ejection portion (108C, 108M, 108Y) for ejecting the color ink eject the ink, so that the fixing property of the color ink can be improved.

Third Embodiment

Figure 8:
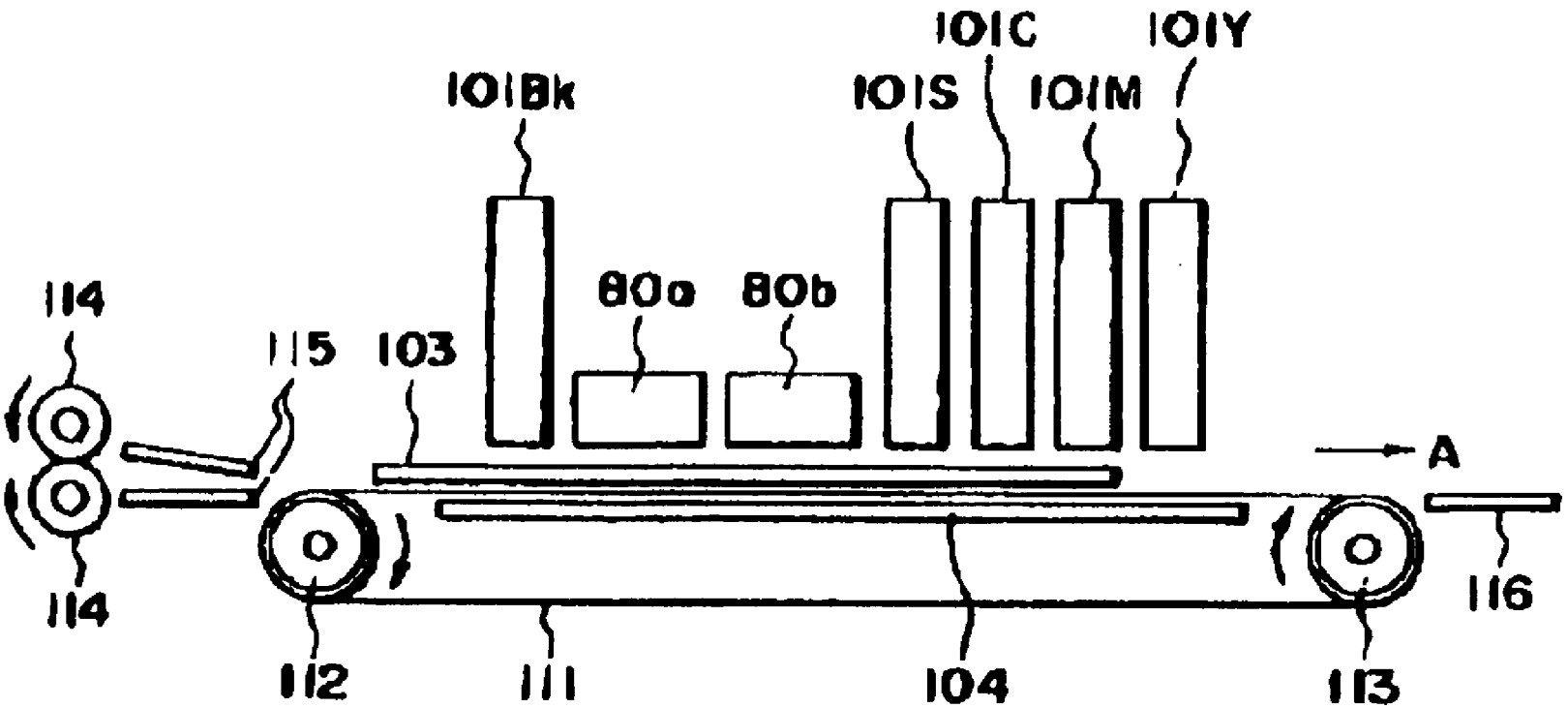
FIG. 8 is a side view of a full-line type recording device according to a third embodiment of the present invention.

FIG. 8 is a side view of a full-line type recording device according to a third embodiment of the present invention. The same reference numerals as in FIG. 1 are assigned to the elements having the corresponding functions, and detailed descriptions thereof are omitted for simplicity.

The recording device of FIG. 8 is similar to the recording device 1 of FIG. 1, but has additional heaters 80*a*, 80*b* between the head 101Bk for the black ink and the head 101S for the processing liquid, and the black ink has a semi-penetrative property. The processing liquid has a penetration property higher than the black ink. By using them, the heating of the heaters 80*a*, 80*b* is effected after the black ink ejection, the penetration of the black ink is substantially confined in the region adjacent the surface of the recording paper 103, so that the record density is high. In addition, the processing liquid is ejected by the head 101S with this state, and therefore, the black ink can be insolubilized while the penetration of the black ink is confined adjacent the surface of the recording paper 103.

Figure 9:
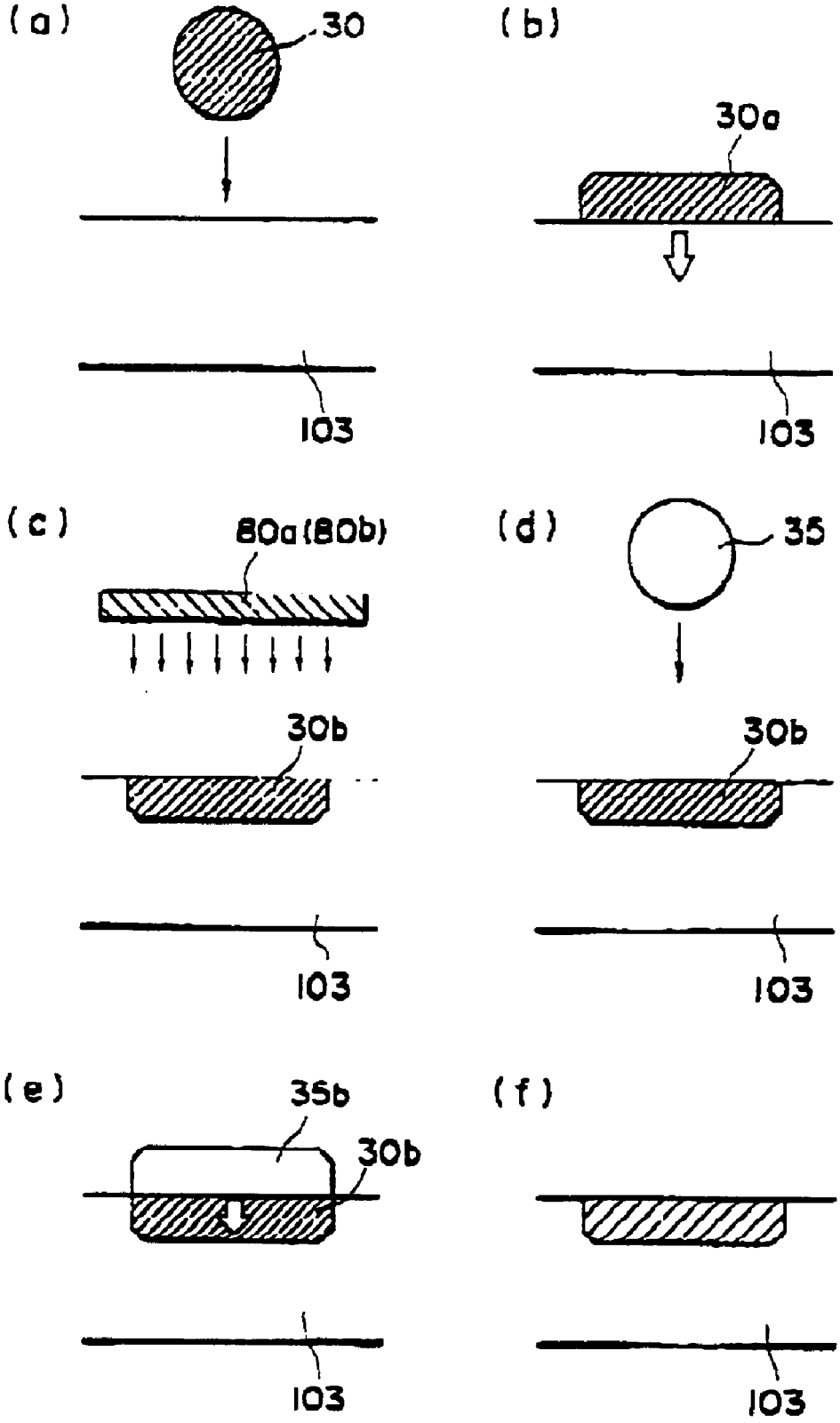
FIG. 9 is an illustration of a process in a recording device of full-line type according to the third embodiment.

Referring to FIG. 9, a description will be provided as to a recording process of the recording device shown in FIG. 8, and the state of the ink and the dot on and in the recording paper 103.

The black ink droplet 30 is ejected by black ink head 101Bk (FIG. 9, (a)). The black ink droplet 30*a* is deposited on the recording paper surface, and penetrates as indicated by a white arrow (FIG. 9, (b)).

During the period from the ejection of the black ink droplet 30 to the recording paper 103 being fed to the position of the head 101S, the dot 30*b* formed on the recording paper 103 is heated by the heaters 80*a*, 80*b*, and the evaporation of the water content is promoted during this period so that the fixing property is improved, and the penetration of the ink into the recording paper 103 is suppressed. Therefore, hardly any ink remains on the surface of the recording paper 103, and the processing liquid is ejected and overlaid thereon after the state of FIG. 9, (c) is reached, wherein the ink is penetrated to a shallow position from the surface of the recording paper 103.

When the recording paper 103 is further fed, the processing liquid droplet 35 is ejected to be overlaid on the dot 30*b* formed by the ejection of the ink by the black ink head 101Bk, by the processing liquid head 101S.

By the penetration of the processing liquid droplet 35*b* as indicated by the white arrow, it reacts with the dye in the black ink (FIG. 9, (e)). As a result, the dye is insolubilized in the recording paper 103 (FIG. 9, (f)).

The reaction occurs under the surface layer of the recording paper 103, and therefore, the reaction products provided by the insolubilization, hardly remains on the surface of the recording paper 103, as shown in FIG. 9, (f).

By the reaction, the penetration of the black ink further into the recording paper 103 can be suppressed, and therefore, the image density of the black ink can be further improved.

As described in the foregoing, according to this embodiment, by effecting the heating by the heaters 80*a*, 80*b* after the ejection of the semi-penetrative black ink, penetration of the black ink into the recording paper 103 can be suppressed, and with this state, the processing liquid is ejected, so that black ink is insolubilized inside the recording paper 103. By such insolubilization, the wear resistance and the overwriting resistance, as well as the water-resistance, are improved. Since the penetration of the black ink to the deep position of the recording paper 103 can be suppressed, the density of the image of the black ink can be increased, and therefore, sharp characters and line images can be provided.

Since the processing liquid has a higher penetration property than the black ink, the processing liquid penetrates into the recording paper 103 at a speed higher than the penetration speed of the black ink and reacts with the black ink, so that penetration of the black ink into the recording paper 103 can be suppressed. By the solvent being separated by the insolubilization of the coloring material, the black ink penetrates into the recording paper 103, so that the fixing property is improved.

(Modified Example of the Third Embodiment)

Figure 10:
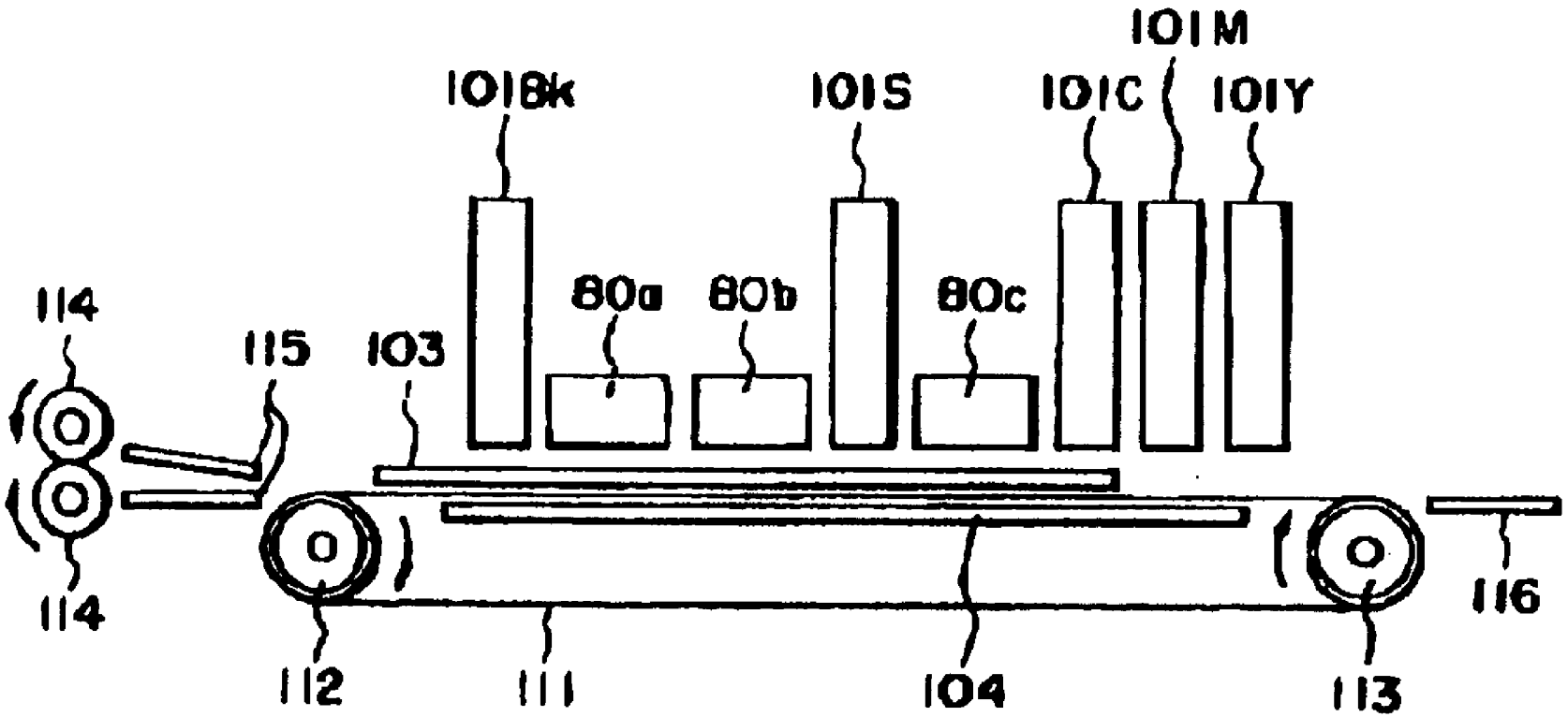
FIG. 10 is a side view of a recording device of a full-line type according to a modification of the third embodiment.

FIG. 10 is a side view of a recording device of a full-line type according to a modification of the third embodiment. The same reference numerals as in FIG. 8 are assigned to the elements having the corresponding functions, and detailed descriptions thereof are omitted for simplicity.

The recording device of FIG. 10 is the same as the recording device of FIG. 8 except that heater 80*c* is added between the head 101S for the processing liquid and the head 101C for the color (C) ink. With this structure, the heating by the heater 80*c* is carried out also after the processing liquid ejection.

Figure 11:
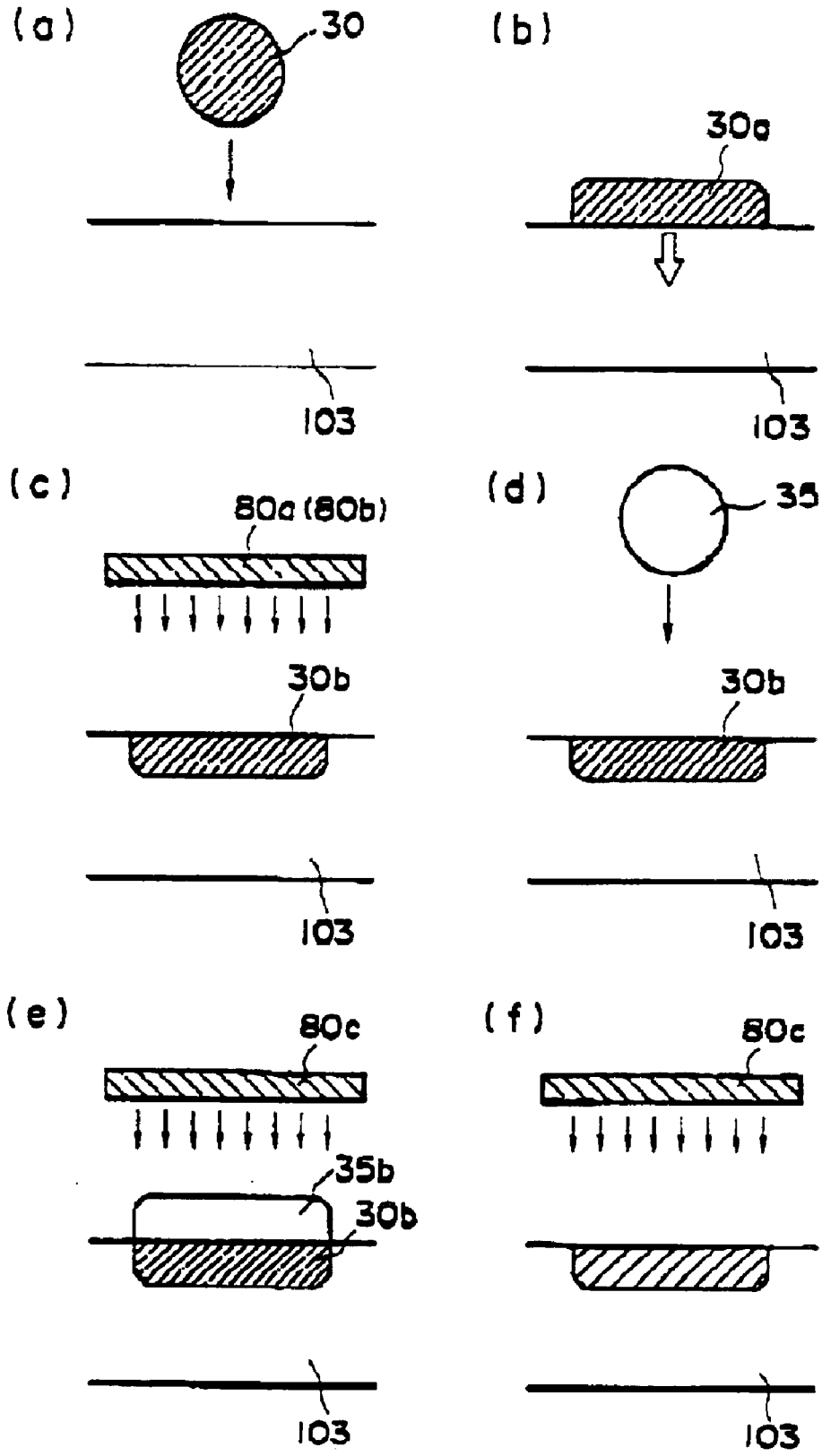
FIG. 11 is an illustration of a recording process in a recording device of a full-line type according to a modification of the third embodiment.

Referring to FIG. 11, a description will be provided as to a recording process of the recording device of FIG. 10 and the state of ink and dot on and in the recording paper 103. Except for the difference described above, the recording process shown in FIG. 11, (a)–(d) is similar to that of FIG. 9, (a)–(d), and therefore, the detailed description thereof is omitted.

The heating by the heater is carried out after the ejection of the black ink droplet 30, and then, the processing liquid droplet 35 is ejected to and overlaid on the dot 30*b* (FIG. 11, (a)–(b)).

When the processing liquid is ejected, and the recording paper 103 is further fed, the heater 80*c* effects the heating (FIG. 11, (e)). By this, the dot 30*b* provided by the black ink and the processing liquid droplet 35*b* ejected to be overlaid on the dot 30*b* are heated, so that evaporation of the water content in the black ink and the solvent of the processing liquid are promoted (FIG. 11, (f)). By the evaporation of the water content in the solvent, the possible flow of the insolubilized coloring material with the penetration of the solvent can be prevented, so that feathering can be prevented, and therefore, the image quality of the characters and the line images of the black ink can be further improved.

Even if a color dot(unshown) is printed adjacent to the dot 30*b* of the black ink in the structure of the FIG. 8 or 10, no spread at the boundary between the black and the color is produced since the coloring material of the black ink is insolubilized inside the recording paper 103, similarly to first embodiment.

Fourth Embodiment

Figure 12:
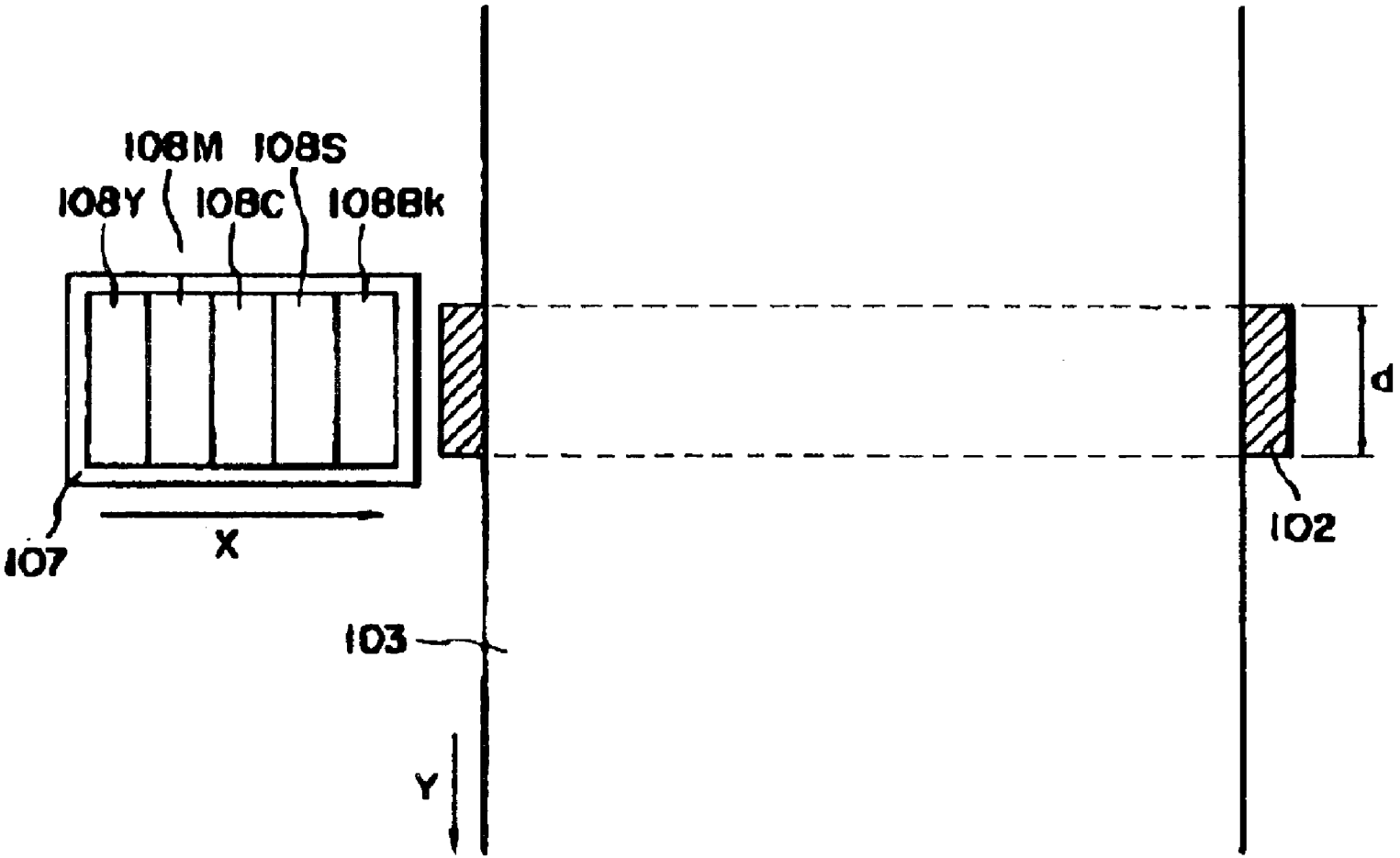
FIG. 12 is a schematic top plan view of a major part of a recording device of a serial type according to a fourth embodiment.

The general arrangement of the recording device of this embodiment is the same as that of FIG. 5, and FIG. 12 schematically is a top plan view of the recording station (126). The recording device is intended to accomplish a recording process that is the same as the recording process of the recording device of the full-line type according to the third embodiment, in a serial type.

With the structure of serial type in the second embodiment, the black ejection portion 108Bk and the processing liquid ejecting portion 108S are deviated by the recording width d in the feeding direction Y.

In the serial-type recording device of FIG. 12, the black ink is ejected by the black ejection portion 108Bk, and then it is heated by the heater 102 to a predetermined degree, and thereafter, the processing liquid and the color ink are sequentially ejected. At a position corresponding to the region scanned by the carriage 107 carrying each head, the heater 102 is disposed in close contact to the back side of the recording paper, so that regions for the ejections by the black ejection portion 108Bk and the processing liquid ejecting portion 108S are the same. The scanning by all heads is completed by the two scans with a time difference therebetween, so that coloring material in the black ink is prevented from insolubilizing at the surface of the recording paper.

More particularly, in the first recording scan, the black ejection portion 108Bk ejects the black ink. Without feeding the recording paper 103, a second recording scan is effected a predetermined period thereafter, to eject the processing liquid by the processing liquid ejecting portion 108S and the ejection of the color inks (cyan, magenta and yellow) by the color ejection portions (108C, 108M, 108Y). After the two scans, the recording paper 103 is fed by the recording width d, and the divided scannings are repeated. The heater 102 is kept on during the recording operation, but since the scanning is divided into two scans, the desired heating is effected so that same effects as in the third embodiment are provided.

Figure 13:
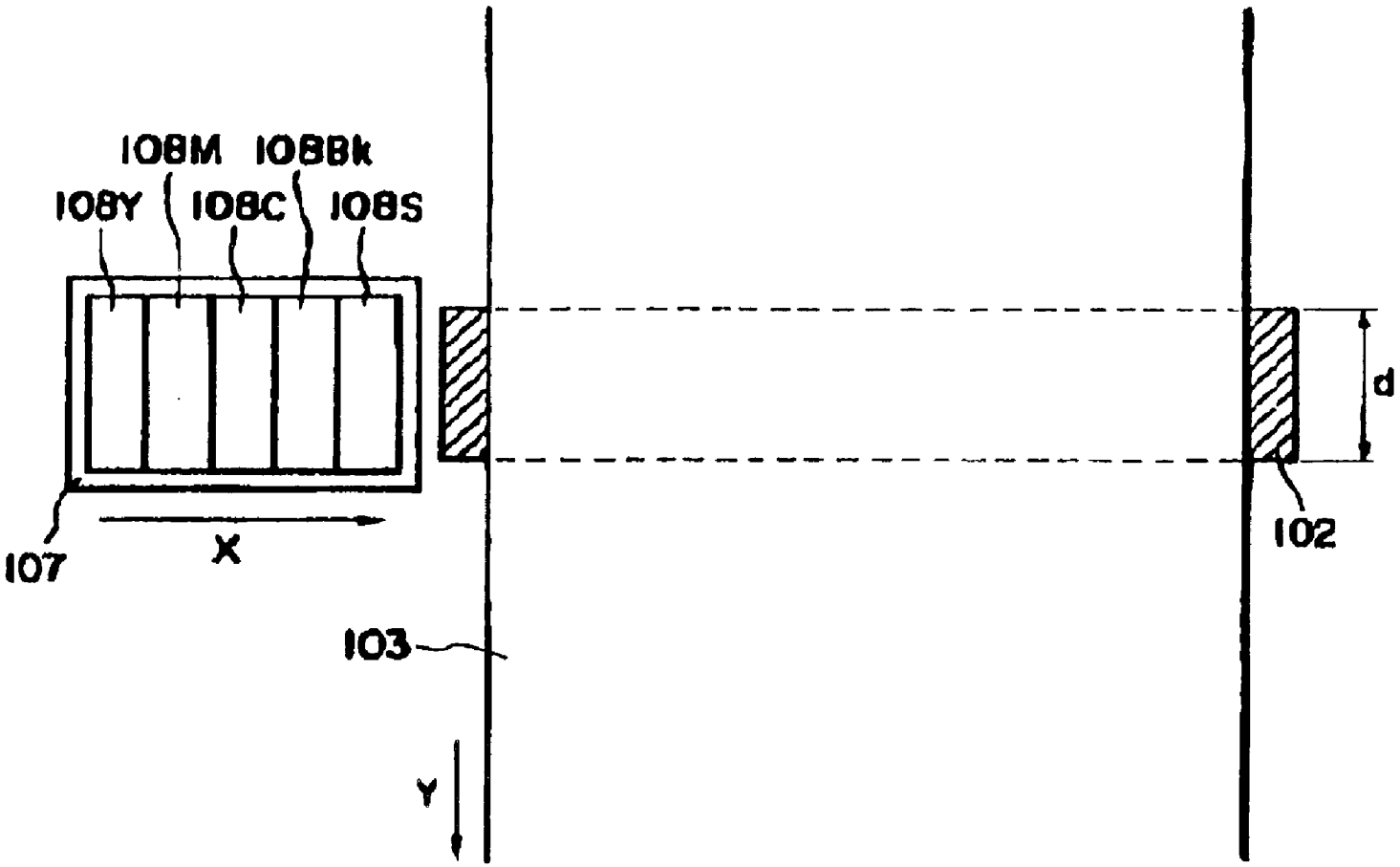
FIG. 13 is a schematic top plan view of a major part of a recording device of a serial type according to a modification of the fourth embodiment.

In this embodiment, the order of arrangement of the black ink ejecting portion 108Bk, the processing liquid ejecting portion 108S and the color ejection portions 108C, 108M, 108Y, is not limited by the feeding direction of the carriage 107 (direction X in the figure). For example, as shown in FIG. 13, which is a top plan view of the recording station (126), the color ejecting portions 108Y, 108M, 108C, the black ejection portion 108Bk and the processing liquid ejecting portion 108S may be arranged in this order in the X direction from the left side in the figure on the carriage 107, in which case, the black ejection portion 108Bk is operated by the first recording scan, and the processing liquid ejecting portion 108S and the color ejection portions are operated in the second recording scan to eject the processing liquid and the color ink.

Fifth Embodiment

Figure 14:
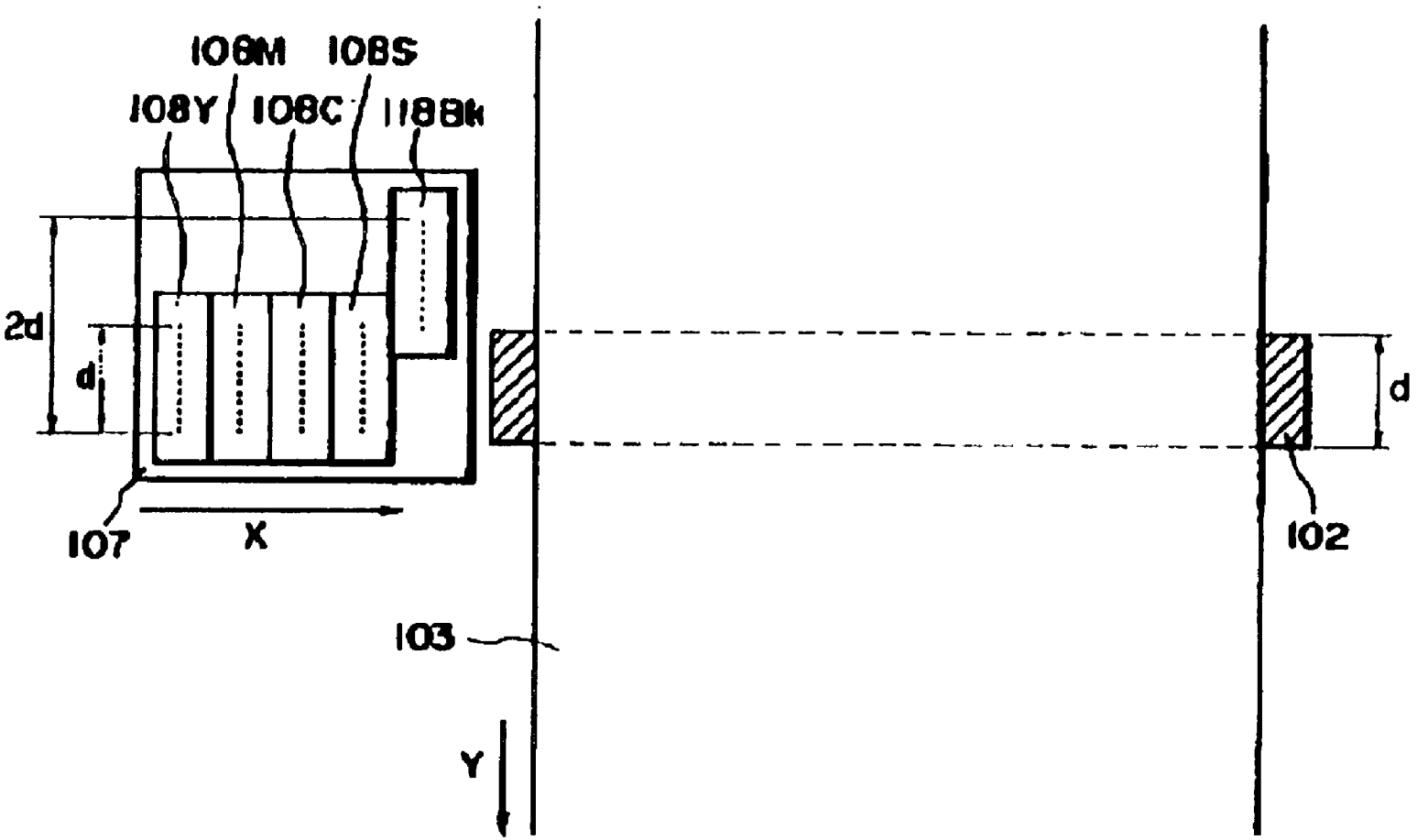
FIG. 14 is a schematic top plan view of a major part of a recording device of a serial type according to a fourth embodiment.
Figure 15:
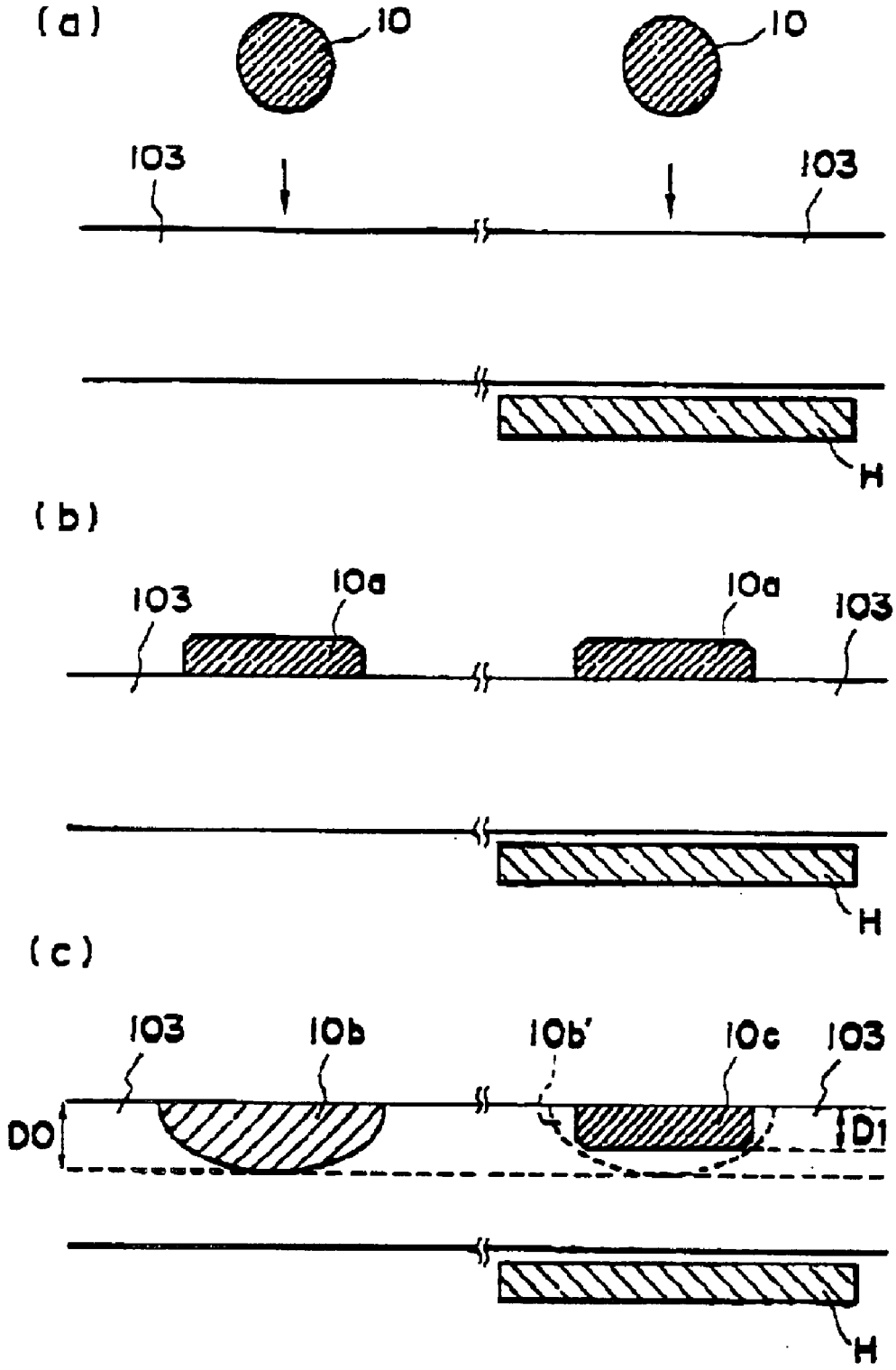
FIG. 15 is an illustration of the difference in the penetration state of the ink into the recording paper, depending on the use or non-use of a heater.

A recording device of this embodiment is the same as that of FIG. 5 (serial type), and FIG. 14 is a top plan view of the recording station (126) of this apparatus.

In this embodiment, the black image is recorded by two scans (divided recording), and the black image formed by the first recording scan is supplemented by the second recording scan to complete the black image. The second scanning is carried out with the predetermined time difference as in the foregoing embodiment. As regards the other color images, they are formed through one scan.

The same reference numerals as in FIG. 7 are assigned to the elements having the corresponding functions, and detailed descriptions thereof are omitted for simplicity. However, in FIG. 14, the black ejection portion 118Bk has ejection outlets capable of providing the recording width 2*d*, which is twice the recording width d of the other ejection portions (processing liquid ejecting portion 108S and the color ejecting portions 108C, 108M, 108Y).

In FIG. 14, each ejection portion has an array of the ejection outlets in the feeding direction Y of the recording paper 103. In the processing liquid ejecting portion 108S and the color ejecting portions (108C, 108M, 108Y), the ejection outlets are arranged in the Y direction so as to cover the width d at a position corresponding to the position of the heater 102, but in the black ejection portion 118Bk, the ejection outlets are arranged over the width 2*d*. The region that is recorded by the black ejection portion 118Bk in the first ejecting scan, is deviated by the recording width d relative to the region recorded by the other ejection portions toward upstream in the feeding direction.

For each X direction scanning of the carriage 107, the recording paper 103 is fed by a distance corresponding to the recording width d in the y direction, and the recording operation by one scan of the carriage 107 and the feeding operation of the recording paper 103 are repeated to effect recording substantially on the entire area on the recording paper 103.

As described hereinbefore, the recording width 2*d* of the black ejection portion 118Bk is wider than the recording width d of the other ejection portion, and therefore, the black ejection portion 118Bk scans twice as much as the other recording region. The black ejection portion 118Bk effects a skipped recording in each of the two scans so that the image recording is completed by two scans.

For example, an upstream side (upper side in the figure), with respect to the recording paper feeding direction Y, of the recording width 2*d* is scanned by the first scan of the black ejection portion 118Bk, and the downstream(lower side in the figure) side thereof is scanned by the second scan. In the first scanning of the carriage 107, the ejection outlets at the upstream side of the black ejection portion 118Bk are used, and the black image is recorded in the skipped manner without heating by the heater 2. The recording paper 103 is fed in the Y direction by a pitch corresponding to the recording width d. In the second scanning of the carriage 107, the downstream-side ejection outlets of the black ejection portion 118Bk is used, to effect the recording for the part skipped in the first scan to supplement the skipped portion (divided ejection of the black ejection portion 118Bk).

By doing so, the first and second scans of the black ejection portion 11Bk are complementary with each other to complete the black image, by which the amount of the black ink ejected by one scan can be reduced. The pattern of the skip may be a staggered pattern or an inverse staggered pattern (checker pattern).

In this manner, the region that has been recorded by the upstream ejection outlet of the black ejection portion 11Bk is subjected in the next scan to the recording by the downstream ejection outlets, the ejection of the processing liquid by the processing liquid ejecting portion 108S, the ejection of the color ink by the color ejecting portions 108C, 108M, 108Y, and the heating by the heater 102.

Thus, according to this embodiment, the ejection amount of the black ink in one scan by the black ejection portion 118Bk is reduced, and the amount of the ink ejected to the neighborhood of another ink is can be minimized, as compared with the single scan. Particularly, when the staggered and inverse staggered patterns are used for the skipping, the ejection to the neighborhood position in X and Y directions in the figure, does not occur. As a result, the overflow of the ink or flow of the ink that may occur when a great number of ink droplets are deposited at adjacent positions do not occur, so that the boundary of the black image can be made further sharp. The ejection time difference between the ejection of the black ink by the downstream(lower side in the figure) ejection outlet of the black ejection portion 118Bk and the ejection of the processing liquid by the processing liquid ejecting portion 108*s*, is shorter than in the second embodiment. However, the black ink already ejected by the upstream(upper side in the figure) ejection outlet has been penetrated into the recording paper 103 at the time of the next scan, and when the ink is deposited to a position adjacent the position at which the black ink is penetrated, the penetration of the later deposited ink is promoted. Therefore, even if the processing liquid is ejected continuously, the ink has been penetrated into the recording paper 103, so that coloring material of the ink can be insolubilized at a shallow position in the recording paper 103.

In the foregoing, the heater 102 has been described as being in operation normally, and it may be turned off when an abnormality sensor 222 detects an abnormality, such as a sheet jam or the like, and the electric energization may be stopped to stop the heat generation operation by using a system controller 201 (FIG. 2, 6).

The present invention is particularly suitably usable in an ink-jet recording head and recording apparatus wherein thermal energy by an electrothermal transducer, a laser beam, or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous-type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from the nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with a quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, the liquid passage and the electrothermal transducer as disclosed in the above-mentioned patents. In addition, the present invention is applicable to the structure disclosed in Japanese Laid-Open Pat. Application No. 123670/1984 wherein a common slit is used as the ejection outlet for plural electrothermal transducers, and to the structure disclosed in Japanese Laid-Open Patent Application No. 138461/1984 wherein an opening for absorbing a pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and plural recording head combined to cover the maximum width.

In addition, the present invention is applicable to a serial type recording head wherein the recording head is fixed on the main assembly, to a replaceable chip type recording head, which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means, which may be the electrothermal transducer, and an additional heating element or a combination thereof. Also, means for effecting preliminary ejection (not for the recording operation) can stabilize the recording operation.

As regards the variation of the recording head mountable, it may be a single head corresponding to a single color ink, or may be plural heads corresponding to the plurality of ink materials having a different recording color or density. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

The ink jet recording apparatus may be used as an output terminal of an information processing apparatus, such as computer or the like, as a copying apparatus combined with an image reader or the like, or as a facsimile machine having information sending and receiving functions.

(Others)

In the mixture of the processing liquid(liquid composition) and the ink in the present invention, the mixture occurs on the recording material on or in the recording material, a low molecular-weight component of the cation materials or the cation oligomer in the processing liquid and the anionic chemical compound in the pigment ink or the water-soluble dye having the anionic base causes association, and instantaneously separation from the liquid phase occurs, in the first stage of the reaction. As a result, dispersion failure occurs, by which coagulated material of the pigment is produced.

As the second stage of the reaction, the association product of the dye and the low-molecular cationic material or the cation oligomer or the coagulated material of the pigment is attracted by the polymeric component contained in the processing liquid, and therefore, the size of the coagulated material of the dye or of the coagulated material of the pigment is increased, so that they do not easily enter the gaps between the fibers; as a result, only the liquid portion resulting from the solid-liquid separation enters the recording paper, and the print quality and the fixing property are both accomplished. The coagulated material formed by the cation material and the anionic dye and the cation oligomer or the low molecular component of the cation substance, or the coagulated material of the pigment, thus produced, have high viscosity, and do not move with the liquid, and therefore, the inks of different colors at adjacent positions do not mix together, and no bleeding occurs. The coagulated material is essentially non-water-soluble, and therefore, the water-resistance of the final image is high. The light resistance of the image formed by the shield effect of the polymer is improved.

Insolubilization and coagulation occur only in the first stage in one example, and they occur in both of the first and second stages in another example.

In the present invention, it is not necessary to use a cation polymeric substance having a large molecular weight or polyatomic metallic salt as in the prior-art, or if it is to be used, it is only for assistance, and therefore, the amount thereof is minimum. As a result, the deterioration of the coloring property of the dye, which has been a problem when the water resistance is provided by the use of the cation polymeric substance or the polyatomic metallic salt, can be avoided.

The recording material used with the present invention is not limited to a particular one, and a conventional copy sheet, bond paper or another plain paper is usable. Coated paper for ink jet printing, a transparent film for OHP, usual high class paper, or glossy paper are usable.

The present method is usable in a system comprising a plurality of machines, or a single machine. The present method may be implemented by supplying a program to a system or an apparatus. In such a case, a storing medium storing a program(software) for implementing the method of the present invention is read out by the system or the apparatus, and this method is actually implemented in the system or the apparatus.

According to the present invention, image quality, water-resistance immediately after the printing, wear resistance, and overwriting resistance are improved.

While the invention has been described with reference to the structures disclosed herein, it is not confined to the details set forth and this application is intended to cover such modifications or changes as may come within the purposes of the improvements or the scope of the following claims.

What is claimed is:

1. A recording method for recording on a recording material using an ink containing a coloring material and a processing liquid for making the coloring material insoluble or coagulate, comprising:

a step of ejecting onto the recording material the ink, the ink having a Ka value of a first value; and a step of applying the processing liquid onto the ink ejected on the recording material, the processing liquid having a Ka value of a second value larger than the first value, wherein the processing liquid is applied onto the recording material after a rapid swell start point ts passes after penetration of the ink into the medium so that the processing liquid is overlapped with the ink ejected on the recording material.

2. A recording method according to claim 1, further comprising a step of applying heat to the ink ejected in said ink ejecting step, wherein the Ka value of the ink is not more than 1 ($ml.m^{-2}.msec^{-1/2}$), the ink has a penetration property that increases with heat, and the Ka value of the processing liquid is more than 1 ($ml.m^{-2}.msec^{-1/2}$).

3. A recording method according to claim 1, further comprising the step of applying heat to a reaction product of the ink and the processing liquid after said processing liquid applying step.

4. A recording method according to claim 1, wherein the Ka value of the processing liquid is not more than 5 ($ml.m^{-2}.msec^{-1/2}$).

5. A recording method according to claim 1, wherein the ink contains pigment.

6. A recording method according to claim 1, further comprising a step of ejecting a second ink different from the ink having the Ka value of the first value, wherein the ink having the Ka value of the first value is a black ink, and the second ink is a color ink, the black ink having a Ka value of not more than 3 ($ml.m^{-2}.msec^{-1/2}$) and the color ink having a Ka value of not less than 5 ($ml.m^{-2}.msec^{-1/2}$), and after application of the processing liquid having a Ka value of not less than 5 ($ml.m^{-2}.msec^{-1/2}$), the color ink is ejected.

7. A recording method according to claim 1, wherein the ink and the processing liquid are ejected to the recording material by generating a bubble by application of thermal energy to the ink and to the processing liquid.

8. A recording method according to claim 1, wherein the Ka of the processing liquid is not less than 5 ($ml.m^{-2}.msec^{-1/2}$).

9. A recording method according to claim 8, wherein the Ka of the ink is not more than 3 ($ml.m^{-2}.msec^{-1/2}$).

10. A recording method according to claim 8, wherein the Ka of the ink is not more than 1 ($ml.m^{-2}.msec^{-1/2}$).

11. A recording method according to claim 1, wherein the ink has a first polarity and the processing liquid has a second polarity opposite from the first polarity.

12. A recording method according to claim 1, wherein a concentration of a surface-active agent in the processing liquid is not less than the critical micelle concentration of the surface-active agent in pure water.

13. A recording method according to claim 1 or 12, wherein a concentration of a surface-active agent in the ink is less than the critical micelle concentration of the surface-active agent in pure water.

* * * * *

UNITED STATES PATENT AND TRADEMARK OFFICE

CERTIFICATE OF CORRECTION

PATENT NO. : 6,916,092 B2
APPLICATION NO. : 09/131744
DATED : July 12, 2005
INVENTOR(S) : Noribumi Koitabashi et al.

It is certified that error appears in the above-identified patent and that said Letters Patent is hereby corrected as shown below:

On the title page, at (57), Abstract:

Line 5, “insolubilized” should read --insolubilize--.
Line 8, “point to” should read --point ts--.

Column 1:

Line 64, “m $m^{-2}$” should read --m1.$m^{-2}$--.

Column 4:

Line 9, “m $m^{-2}$” should read --m1.$m^{-2}$--.
Line 36, “travailing” should read --traveling--.
Line 63, “In” should read --in--.

Column 5:

Line 40, “tetrainethyl” should read --tetramethyl--.

Column 7:

Line 7, “close” should read --close to--.

Column 11:

Line 24, “buffer” should read --buffers--.

Column 17:

Line 61, “y direction” should read --Y direction--.

UNITED STATES PATENT AND TRADEMARK OFFICE

CERTIFICATE OF CORRECTION

PATENT NO. : 6,916,092 B2
APPLICATION NO. : 09/131744
DATED : July 12, 2005
INVENTOR(S) : Noribumi Koitabashi et al.

It is certified that error appears in the above-identified patent and that said Letters Patent is hereby corrected as shown below:

Column 18:
Line 22, "11Bk" should read --118Bk--.
Line 28, "11Bk" should read --118Bk--.
Line 49, "108s" should read --108S--.

Signed and Sealed this

Thirtieth Day of January, 2007

JON W. DUDAS
*Director of the United States Patent and Trademark Office*